US007147980B2

(12) United States Patent
Itakura et al.

(10) Patent No.: US 7,147,980 B2
(45) Date of Patent: Dec. 12, 2006

(54) TONER AND IMAGE FORMING APPARATUS

(75) Inventors: Takayuki Itakura, Shizuoka (JP); Takaaki Kotaki, Shizuoka (JP); Yasuhiro Ichikawa, Kanagawa (JP); Takaaki Kaya, Shizuoka (JP); Wakashi Iida, Ibaraki (JP); Hiroyuki Fujikawa, Kanagawa (JP); Kazuhiko Hayami, Shizuoka (JP); Nobuyoshi Sugahara, Shizuoka (JP); Yojiro Hotta, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/753,490

(22) Filed: Jan. 9, 2004

(65) Prior Publication Data

US 2004/0161688 A1 Aug. 19, 2004

(30) Foreign Application Priority Data

Jan. 10, 2003 (JP) ..... 2003-003894
Jan. 5, 2004 (JP) ..... 2004-000159

(51) Int. Cl.
*G03G 9/087* (2006.01)

(52) U.S. Cl. ..... 430/108.4; 430/108.8; 430/109.2; 430/109.3; 430/109.4; 430/110.3; 430/124

(58) Field of Classification Search ..... 430/109.2, 430/108.4, 110.3, 111.4, 109.3, 109.4, 108.8, 430/124
See application file for complete search history.

(56) References Cited

U.S. PATENT DOCUMENTS

| | | | | |
|---|---|---|---|---|
| 4,301,355 | A | 11/1981 | Kimbrough et al. | 219/137 PS |
| 4,921,771 | A | 5/1990 | Tomono et al. | |
| 5,525,775 | A | 6/1996 | Setoriyama et al. | 219/216 |
| 5,547,800 | A | 8/1996 | Nishimori et al. | |
| 5,745,833 | A * | 4/1998 | Abe et al. | 399/330 |
| 6,077,635 | A * | 6/2000 | Okado et al. | 430/45 |
| 6,096,468 | A * | 8/2000 | Ohno et al. | 430/108.3 |
| 6,203,959 | B1 * | 3/2001 | Tanikawa et al. | 430/108.8 |
| 6,235,441 | B1 | 5/2001 | Tanikawa et al. | |
| 6,261,731 | B1 * | 7/2001 | Iemura et al. | 430/108.3 |
| 6,528,222 | B1 | 3/2003 | Kohtaki et al. | 430/108.21 |
| 6,670,087 | B1 | 12/2003 | Fujikawa et al. | 430/109.2 |

FOREIGN PATENT DOCUMENTS

| | | | |
|---|---|---|---|
| EP | 0658818 | | 11/1994 |
| JP | 51-109739 | | 9/1976 |
| JP | 52-3304 | | 1/1977 |
| JP | 52-3305 | | 1/1977 |
| JP | 57-52574 | | 3/1982 |
| JP | 59-33787 | | 2/1984 |
| JP | 63-313182 | | 12/1988 |
| JP | 1-161261 | | 6/1989 |
| JP | 1-185660 | | 7/1989 |
| JP | 1-185661 | | 7/1989 |
| JP | 1-185662 | | 7/1989 |
| JP | 1-185663 | | 7/1989 |
| JP | 1-238672 | | 9/1989 |
| JP | 2-157878 | | 6/1990 |
| JP | 4-44075 | | 2/1992 |
| JP | 4-107467 | | 4/1992 |
| JP | 4-149559 | | 5/1992 |
| JP | 4-204980 | | 7/1992 |
| JP | 4-301853 | | 10/1992 |
| JP | 5-61238 | | 3/1993 |
| JP | 5-346686 | | 12/1993 |
| JP | 6-59504 | | 3/1994 |
| JP | 08-044107 | | 2/1996 |
| JP | 8-54750 | | 2/1996 |
| JP | 11-7151 | | 1/1999 |
| JP | 11-84716 | | 3/1999 |
| JP | 2000-292985 | | 10/2000 |
| JP | 2001-60018 | | 3/2001 |
| JP | 2001-175029 | * | 6/2001 |
| JP | 2002-091078 | | 3/2002 |
| JP | 2002-131969 | | 5/2002 |

OTHER PUBLICATIONS

Japanese Patent Office machine-assisted translation of JP 2001-175029 (pub. Jun. 2001).*

* cited by examiner

*Primary Examiner*—Janis L. Dote
(74) *Attorney, Agent, or Firm*—Fitzpatrick, Cella, Harper & Scinto

(57) ABSTRACT

A toner having toner particles each comprising at least a binder resin, a wax, and a colorant is used in an image forming apparatus which has a fixing means comprising a belt-shaped heating member and a pressurizing member. The binder resin contains a resin formed by a reaction between an epoxy group of a vinyl resin (A) having the epoxy group and a carboxyl group of a resin (B) having at least a polyester unit and the carboxyl group. The toner has a storage elastic modulus at a temperature of 80° C. (G' 80) in the range of $1\times10^5$ to $1\times10^8$ Pa and has a storage elastic modulus at a temperature of 160° C. (G' 160) in the range of $1\times10^1$ to $1\times10^4$ Pa.

10 Claims, 5 Drawing Sheets

TONER AND IMAGE FORMING APPARATUS

This application claims the right of priority under 35 U.S.C. §119 based on Japanese Patent Application Nos. JP 2003-003894 and JP 2004-000159 which are hereby incorporated by reference herein in their entirety as if fully set forth herein.

BACKGROUND OF THE INVENTION

1. Field of the Invention

The present invention relates to a toner used for a method for forming images such as an electrophotographic method, an electrostatic recording method, an electrostatic printing method, and a toner jet method. The present invention also relates to a toner and an image forming apparatus that are suitably used for a heating device employed to an on-demand heating system which uses no oil or uses oil only in a small amount.

2. Description of the Related Art

Due to demands for space and energy savings etc., rigorous pursuits have been made to achieve miniaturization, weight reduction, higher speed, and higher reliability of copiers and printers in recent years. Accordingly, those machines are increasingly constructed from components that are simplified in many aspects. As a result, increasingly higher performance is required of toner, and an improvement in toner performance is desired.

Generally, it is required for toners loaded in full-color copying machines that the respective toners be sufficiently color-mixed during the step of heat- and pressure-fixing a toner image, without impairing improvement in color reproducibility and transparency of images on a sheet for overhead projectors (OHP). As compared with black toner generally used for monochrome copying machines, it is preferred that toner for developing full-color images be mainly composed of a low molecular weight binder resin having sharp melting property.

However, in general, using a sharp melt binder resin tends to pose a problem in hot offset resistance owing to the low self-agglomeration force of the binder resin when the toner melts in the step of heat- and pressure-fixing.

In a general black toner for a monochrome copier, as proposed, for example, in JP 52-03304 B, JP 52-03305 B, and JP 57-52574 A, a relatively high crystallinity wax typified by a polyethylene wax or a polypropylene wax is used as a releasing agent in order to improve hot offset resistance upon fixing.

With toners for developing full color images, when an image is projected using the OHP, the image is degraded in chroma and lightness because a transparency of the image is impaired due to high crystallinity of the releasing agent itself and a difference in refractive index from a material of OHP sheet.

In order to solve the above problem, a toner having a specific storage elastic modulus has been proposed. For example, JP 11-84716 A and JP 8-54750 A propose a toner having a specific storage elastic modulus at 180° C. and 170° C., respectively.

However, the above-mentioned toner is too low in viscosity to be used as a color toner that is required to realize both low-temperature fixability and hot offset resistance and provide favorable fixability and satisfactory color-mixing characteristics when used with heat- and pressure-fixing means using no or only a small amount of oil for preventing hot-offset. In addition, the toner proved to be inadequate also in terms of shelf life under high temperature environments.

Further, JP 11-7151 A and JP 6-59504 A propose a toner having a specific storage elastic modulus G' at 70 to 120° C. and a toner having a specific loss elastic modulus G" at 130 to 180° C.

However, the above-mentioned toners proved to be inadequate from the viewpoints of providing sufficient shelf life under high temperature environments, obtaining high quality images with stability in outputting images in large quantity, and attaining chargeability and developability with stability irrespective of the usage environment.

In order to solve the above problems, JP 4-149559 A and JP 4-107467 A propose a method for reducing crystallinity of wax by using a core forming agent in combination with wax. In addition, a method for using wax having a low crystallinity is proposed in JP 4-301853 A and JP 5-61238 A. Further, examples of wax having a relatively high transparency and a low melting point include montan-based wax, the use of montan-based wax is proposed in JP 1-185660 A, JP 1-185661 A, JP 1-185662 A, JP 1-185663A, and JP 1-238672 A.

However, the waxes mentioned above are not fully satisfactory in terms of all of the transparency when used with OHP, the low temperature fixability and the hot offset resistance upon heat- and pressure-fixing.

On the other hand, with regard to the heat- and pressure-fixing means in which oil for preventing hot offset is not used or used only in a small amount, various studies have also been made as to the means for improving the binder resin. As one such means, a composition in which wax is added to a resin having an epoxy group is proposed in JP 1-161261 A, JP 5-346686 A, JP 2000-292985 A, and JP 2001-60018 A.

However, none of the above publications refers to viscoelastic properties of a toner for achieving oilless fixing with a sufficiently wide fixable area when those resins are used. Moreover, as a binder resin particularly preferable as a resin that causes a crosslinking reaction with an epoxy group, none of the above publications proposes a combination with a hybrid resin having a polyester unit and a vinyl-based polymer unit.

Conventionally, in image forming apparatuses using an electrophotographic process, a device using a heated roller system is widely used as a fixing device for heat-fixing an unfixed image (toner image) to a recording material (transferring material sheet, electrofax sheet, electrostatic recording paper, OHP sheet, printing paper, formatted paper etc.).

Recently, however, use of image fixing devices using a film heating system have come into wide use from the viewpoints of quick-start and energy saving, as proposed, for example, in JP 63-313182 A, JP 2-157878 A, JP 4-44075 A, JP 4-204980 A, and the like.

In the film heating system, a heat-resisting film (fixing film) is nipped between a ceramic heater serving as a heating member and a pressurizing roller serving as a pressurizing member to form a nip portion, and a recording material bearing an unfixed toner image thereon is introduced between the film and the pressurizing roller in the nip portion. The recording material is then nipped and conveyed together with the film so that, in the nip portion, the heat of the ceramic heater is applied to the recording material through the film, thus heat- and pressure-fixing the unfixed toner image to a surface of the recording material by the heat and the pressurizing force applied in the nip portion.

Such a fixing device using the film heating system can be constructed as an on-demand type device by use of the ceramic heater and a low heat-capacity member serving as the film. Accordingly, the ceramic heater may be turned on by electricity to heat to a predetermined fixing temperature only when carrying out image formation, with the result that a waiting time from the power-on of the image forming apparatus until the image forming apparatus becomes ready to carry out image formation is short (quick-start property), making it possible to considerably restrain the power consumption during stand-by (energy saving property).

From the viewpoints of quick-start and energy saving, adopted as a method different from the above-described method is use of a fixing device that employs an induction heating system utilizing high-frequency induction as a heating source, as proposed in JP 51-109739 U and JP 59-33787 A.

The induction-heating fixing device mentioned above has a coil arranged concentrically therewith in the interior of a hollow fixing roller made of a metallic conductor. An induction eddy current is generated in the fixing roller by means of high-frequency magnetic fields generated by flowing a high-frequency current through the coil, and the fixing roller itself is subjected to Joule heating due to a skin resistance of the fixing roller itself. Electricity/heat conversion efficiency is remarkably improved with the fixing device using the induction heating system, thus making it possible to reduce the warm-up time.

In addition, using a core (magnetic field blocking member) consisting of a magnetic material in combination with the coil allows the high-frequency magnetic fields to be generated in an efficient manner. In particular, when a core having a T-shaped cross section is used, a quantity of heat required of the fixing device can be generated with low power consumption due to efficient concentration of the high-frequency magnetic fields and a magnetic field blocking effect of blocking propagation of the magnetic fields to portions other than a heat generation portion.

However, the prior art techniques described above pose the following problems. In the case of the above-described fixing device using the induction heating system, to make full use of its advantage of reducing the time required until a temperature of the fixing roller surface reaches a temperature suitable for fixing upon startup of the fixing device, it is preferable to make the heat quantity of the fixing roller as low as possible. However, when a thin fixing roller is used for the above reason, it is difficult to set the pressurizing force applied in the nip portion to be high due to the problem of rigidity of the fixing member, which in turn makes it difficult to set a low fixing temperature.

In addition, in the above-mentioned case, heat is not easily transferred in the rotation axis direction of the fixing roller. Thus, for instance, when sheets of paper having a small size are continuously fed, a large difference in the temperature of the fixing roller is liable to develop between a sheet feeding portion and a non-sheet feeding portion. When the sheet heating portion of the fixing roller is adjusted in temperature at this time, a temperature of the non-sheet feeding portion may largely exceed a temperature suitable for fixing, with the result that toner is easily offset to the fixing roller surface in the non-sheet feeding portion or paper clogging easily occurs to tie the paper around the fixing roller.

Further, the high-frequency magnetic fields generated by flowing a high-frequency current through the coil is prone to the problem of scattering upon fixing, because the magnetic fields slightly leak out from the magnetic field blocking member to disturb an unfixed magnetic toner image on the recording material before entering the fixing device. Although these problems can be solved by increasing a transfer current during the transfer process to increase the electrostatic force between the toner and the recording material, this causes a discharge current under a high electric field environment to reach even a photosensitive member, thus damaging a surface of the photosensitive member to reduce the life of the photosensitive member.

Further, in a system using the induction heating type fixing device, as mentioned above, a part of the magnetic material separated from the toner is liable to disturb an unfixed image due to the high-frequency magnetic fields leaking out from the fixing device.

Increasingly sophisticated performance is required of toner applied to the on-demand type fixing system using low heat capacity members as the ceramic heater and the film or the fixing system using the induction heating described above as compared with other systems. Thus, there is a demand for a toner with which fixing can be effected even under a low pressure and a low temperature.

The need for the low-temperature fixability of toner is particularly high in the case of a fixing arrangement in which a large pressure is not applied during the fixing process and a releasing agent is separated by fusing onto the toner surface and fixed; when the releasing agent is not present near the toner surface, releasability from the fixing member is not sufficiently exhibited and the fixability thus deteriorates. Currently, colorization is achieved in the art in such a way that a color is expressed by mixing of multiple colors. Since a large amount of toner needs to be fixed at once, effective use of resin and wax that are advantageous in terms of fixability is critical.

For the above reason, there is desired a color toner which is capable of achieving both low-temperature fixability and offset prevention when used for the above-described heat- and pressure-fixing means in which oil for preventing hot offset is not used or used only in a small amount, and which is also excellent in terms of transparency of a fixed image.

SUMMARY OF THE INVENTION

It is an object of the present invention to provide a toner that solves the problems mentioned above.

It is an object of the present invention to provide a toner which has good transparency when used in OHP and is excellent in hot offset resistance.

It is an object of the present invention to provide a toner that is excellent in low-temperature fixability.

It is an object of the present invention to provide a toner that is excellent in blocking resistance.

It is an object of the present invention to provide a toner which does not cause a cleaning failure easily.

It is an object of the present invention to provide a toner that is excellent in transferability and has good dot reproducibility.

It is an object of the present invention to provide an image forming apparatus that solves the above-mentioned problems.

It is an object of the present invention to provide an image forming apparatus which has good transparency when used in OHP and is excellent in hot offset resistance.

It is an object of the present invention to provide an image forming apparatus that is excellent in low-temperature fixability.

It is an object of the present invention to provide an image forming apparatus that is excellent in blocking resistance.

It is an object of the present invention to provide an image forming apparatus which does not cause a cleaning failure easily.

It is an object of the present invention to provide an image forming apparatus that is excellent in transferability and has good dot reproducibility.

The present invention relates to a toner comprising toner particles each comprising at least a binder resin, a wax, and a colorant, wherein:

the binder resin comprises a resin formed by a reaction between an epoxy group of a vinyl resin (A) having the epoxy group and a carboxyl group of a resin (B) having at least a polyester unit and the carboxyl group; and the toner has a storage elastic modulus at a temperature of 80° C. (G' 80) in the range of $1\times10^5$ to $1\times10^8$ Pa and has a storage elastic modulus at a temperature of 160° C. (G' 160) in the range of $1\times10^1$ to $1\times10^4$ Pa.

Further, the invention relates to an image forming apparatus for forming a toner image fixed onto a recording material, the image forming apparatus comprising a means for forming an unfixed toner image on the recording material and a fixing means for fixing the unfixed toner image to the recording material, wherein:

the fixing means has a heating means, a rotatable endless fixing belt heated by the heating means, and a pressurizing member pressurizing the fixing belt to form a nip portion in which the recording material is nipped between the fixing belt and the pressurizing member, the fixing means is a means for fixing the unfixed toner image formed on the recording material to the recording material in the nip portion;

the fixing belt has a tubular metallic conductor and an elastic layer covering an outer peripheral surface of the metallic conductor;

the heating means is a means for heating the fixing belt by generating an eddy current in the fixing belt;

a toner for forming the toner image comprises toner particles each comprising at least a binder resin, a wax, and a colorant;

the binder resin comprises a resin formed by a reaction between an epoxy group of a vinyl resin (A) having the epoxy group and a carboxyl group of a resin (B) having at least a polyester unit and the carboxyl group; and the toner has a storage elastic modulus at a temperature of 80° C. (G' 80) in a range of $1\times10^5$ to $1\times10^8$ Pa and has a storage elastic modulus at a temperature of 160° C. (G' 160) in a range of $1\times10^1$ to $1\times10^4$ Pa.

Furthermore, the present invention relates to an image forming apparatus for forming a toner image fixed onto a recording material, the image forming apparatus comprising a means for forming an unfixed toner image on the recording material and a fixing means for fixing the unfixed toner image to the recording material, wherein:

the fixing means has a heating means, a rotatable endless heat-resisting film, and a pressurizing means for pressurizing the heat-resisting film against the heating means to form a nip portion in which the recording material is nipped between the pressurizing means and the heat-resisting film, the fixing means is a means for fixing the unfixed toner image formed on the recording material to the recording material in the nip portion;

a toner for forming the toner image comprises toner particles each comprising at least a binder resin, a wax, and a colorant;

the binder resin comprises a resin formed by a reaction between an epoxy group of a vinyl resin (A) having the epoxy group and a carboxyl group of a resin (B) having at least a polyester unit and the carboxyl group; and the toner has a storage elastic modulus at a temperature of 80° C. (G' 80) in a range of $1\times10^5$ to $1\times10^8$ Pa and has a storage elastic modulus at a temperature of 160° C. (G' 160) in a range of $1\times10^1$ to $1\times10^4$ Pa.

According to the present invention, a sufficiently large fixing area and a sufficient transparency can be secured. Therefore, the present invention can be suitably applied to an on-demand type heat-fixing device.

DETAILED DESCRIPTION OF THE PREFERRED EMBODIMENTS

Figure 1:
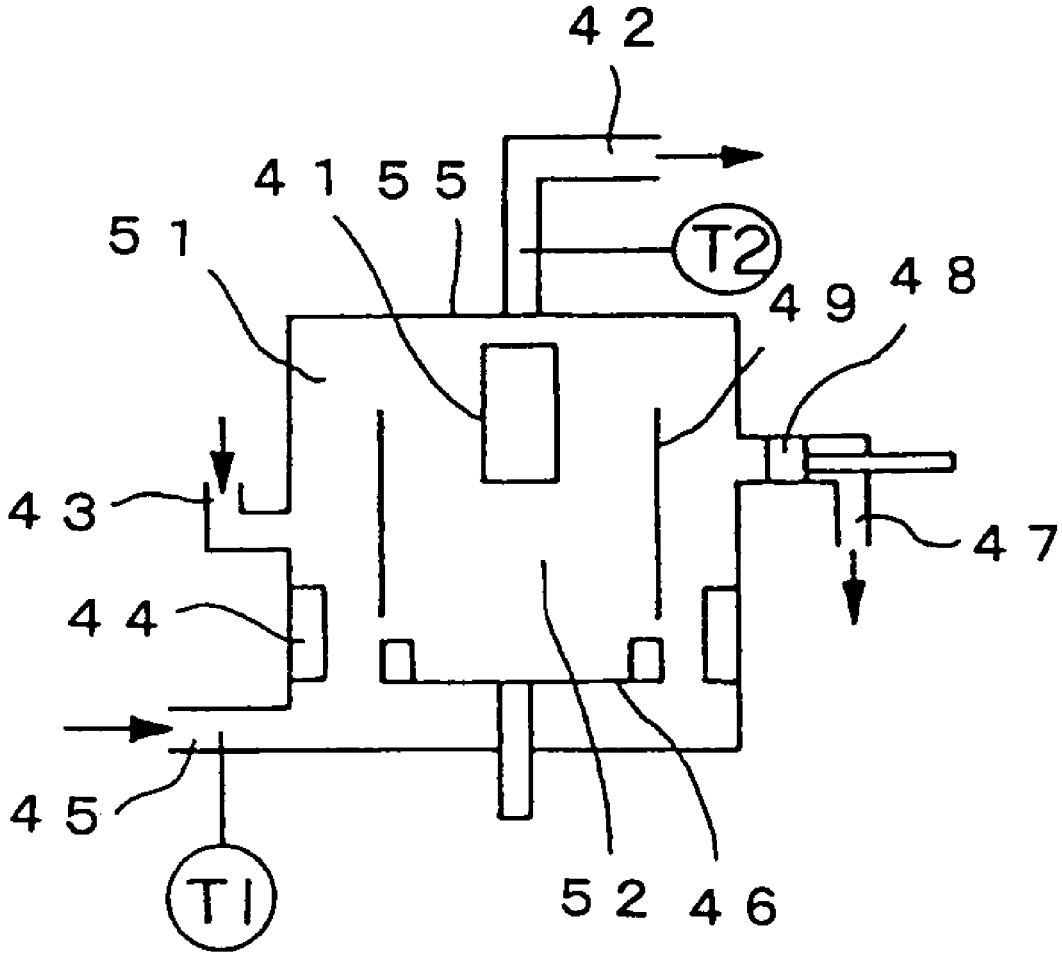
FIG. 1 is a schematic diagram showing an example of a surface modifying device used in the present invention.

The inventors of the present invention have made studies, and as a result, gained the following knowledge. That is, in the case where toner fixing is performed with an on-demand heat-fixing device to fix a toner comprising at least a binder resin, a wax, and a colorant, the binder resin comprising a resin formed by a reaction between an epoxy group of a vinyl resin (A) having the epoxy group and a carboxyl group of a resin (B) having at least a polyester unit and the carboxyl group, the toner having a storage elastic modulus in a specific range in a specific temperature range, a sufficient fixable area can be obtained and excellent transparency can be secured for the toner as a toner for full-color image formation. Hereinafter, the present invention is described in detail.

First, with regard to viscoelastic properties of a toner, a storage elastic modulus at a temperature of 80° C. (G' 80) is preferably in the range of $1\times10^5$ to $1\times10^8$ Pa in order to achieve satisfactory shelf life, heat resistance, and blocking resistance of the toner under a high temperature environment.

In the case where the storage elastic modulus (G' 80) is less than $1\times10^5$ Pa, it is not preferable because the shelf life, heat resistance, and blocking resistance of the toner under a high temperature environment become poor and because toner particles can coalesce to form a large toner aggregate.

In recent years, an increase in the output speed of a copier or of a printer and miniaturization of a main body thereof are progressing, so that a temperature in such a machine tends to increase. Therefore, in order to stably obtain a high-definition and high-quality image, it is important that the toner has sufficient shelf life, heat resistance, and blocking resistance under a high temperature environment. In the case where the storage elastic modulus (G' 80) is greater than $1\times10^8$ Pa, it is not preferable because low-temperature fixability can not be sufficient although the shelf life, heat resistance, and blocking resistance are sufficient.

In addition, with regard to the viscoelastic properties of the toner, a storage elastic modulus at a temperature of 160° C. (G' 160) is preferably in the range of $1\times10^1$ to $1\times10^4$ Pa in order to satisfy offset resistance.

In the case where the storage elastic modulus (G' 160) is less than $1\times10^1$ Pa, it is not preferable because the hot offset resistance can become poor. In the case where the storage elastic modulus (G' 160) is greater than $1\times10^4$ Pa, it is not preferable because low-temperature fixability can not be sufficient although the hot offset resistance is sufficient.

An epoxy group in "a vinyl resin having an epoxy group" used in the present invention is a functional group in which an oxygen atom binds to two carbon atoms in the same molecule, and has a cyclic ether structure. The cyclic ether typically has a structure of a three-membered ring, a four-membered ring, a five-membered ring, or a six-membered ring. Of those, an epoxy group having a three-membered ring structure is preferable.

Examples of a monomer having an epoxy group, the monomer composing the vinyl resin having an epoxy group, include glycidyl acrylate, glycidyl methacrylate, β-methylglycidyl acrylate, β-methylglycidyl methacrylate, acryl glycidyl ether, and allyl β-methylglycidyl ether. In addition, a glycidyl monomer represented by the general formula (1) is preferably used.

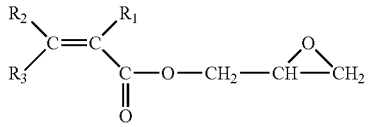

(1)

(In the general formula (1), $R_1$, $R_2$, and $R_3$ independently represent a hydrogen atom, an alkyl group, an aryl group, an aralkyl group, a carboxyl group, and an alkoxycarbonyl group.)

Such a monomer having an epoxy group may be used singly or mixed with one another, copolymerized with a vinyl-based monomer in accordance with a known polymerization method to obtain a vinyl resin having the epoxy group.

The vinyl resin having the epoxy group preferably has an epoxy value in the range of 0.05 to 3.0 eq/kg. In the case where the epoxy value is less than 0.05 eq/kg, a resin crosslinking reaction between the epoxy group and a carboxyl group of a resin to be simultaneously used therewith, the resin having a polyester unit and the carboxyl group, hardly proceeds. Thus, a hot offset resistance improving effect tends not to be exhibited sufficiently.

On the other hand, in the case where the epoxy value exceeds 3.0 eq/kg, the reaction (crosslinking reaction) between the epoxy group and the carboxyl group proceeds excessively, and thus THF-insoluble matter is produced in large quantity. Therefore, exudation of the wax to the toner surface upon fixing is blocked, and the low-temperature fixability and the offset resistance tend to be hardly compatible with each other.

Examples of the vinyl-based monomer that can be used in combination with the monomer having the epoxy group to form the vinyl resin having an epoxy group include the following monomers.

In the toner of the present invention, examples of a vinyl-based monomer for producing the vinyl polymer include: styrene; styrene derivatives such as o-methyl styrene, m-methyl styrene, p-methyl styrene, α-methyl styrene, p-phenyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-chlorostyrene, 3,4-dichlorostyrene, m-nitrostyrene, o-nitrostyrene, and p-nitrostyrene; unsaturated mono-olefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; ∝-methylene aliphatic mono-carboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl amino ethyl methacrylate, and diethyl amino ethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinyl pyrtole, N-vinyl carbazole, N-vinyl indole, and N-vinyl pyrrolidone; vinyl naphthalenes; and acrylic or methacrylic-derivatives such as acrylonitrile, methacrylonitrile, and acrylamide.

Furthermore, there are included: unsaturated dibasic acids such as maleic acid, citraconic acid, itaconic acid, alkenyl succinic acid, fumaric acid, and mesaconic acid; anhydrides of unsaturated dibasic acids such as maleic anhydride, citraconic anhydride, itaconic anhydride, and alkenyl succinic anhydride; half esters of unsaturated dibasic acids such as maleic methyl half ester, maleic ethyl half ester, maleic butyl half ester, citraconic methyl half ester, citraconic ethyl half ester, citraconic butyl half ester, itaconic methyl half ester, alkenyl succinic methyl half ester, fumaric methyl half ester, and mesaconic methyl half ester; esters of unsaturated dibasic acids such as dimethyl maleate and dimethyl fumarate; ∝, β-unsaturated acids such as acrylic acid, methacrylic acid, crotonic acid, and cinnamic acid; α, β-unsaturated acid anhydrides such as crotonic anhydride and cinnamic anhydride; anhydrides of α, β-unsaturated acids and lower fatty acid; and monomers including carboxylic group such as alkenyl malonic acid, alkenyl glutaric acid, and alkenyl adipic acid, anhydrides of these, and monoesters of these.

Furthermore, there are included: esters of acrylic acids or methacrylic acids such as 2-hydroxyethyl acrylate, 2-hydroxyethyl methacrylate, and 2-hydroxypropyl methacrylate; and monomers which have hydroxy groups such as 4-(1-hydroxy-1-methylbutyl)styrene and 4-(1-hydroxy-1-methylhexyl)styrene.

The vinyl-based polymer unit in the hybrid resin according to the present invention may also include a cross-linked structure cross-linked by a cross-linking agent including two or more vinyl groups. Examples of the cross-linking agent for use in this case include the following.

Examples of an aromatic divinyl compound include divinyl benzene and divinyl naphthalene. Examples of diacrylate compounds bonded by alkyl chains include ethylene glycol diacrylate, 1,3-butylene glycol diacrylate, 1,4-butane diol diacrylate, 1,5-pentane diol diacrylate, 1,6-hexane diol diacrylate, neopentyl glycol diacrylate, and a compound whose acrylate is replaced with methacrylate. Examples of diacrylate compounds bonded by alkyl chains including ether bond include diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and a compound whose acrylate is replaced with methacrylate. Examples of diacrylate compounds bonded by chains including aromatic group and ether bond include polyoxyethylene(2)-2,2-bis(4-hydroxyphenyl)propane diacrylate, polyoxyethylene(4)-2,2-bis(4-hydroxyphenyl)propane diacrylate, and a compound whose acrylate is replaced with methacrylate.

Examples of a multifunctional crosslinking agent include: pentaerythritol triacrylate, trimethylol ethane triacrylate, trimethylol propane triacrylate, tetramethylol methane tetraacrylate, oligo ester acrylate, and a compound whose acrylate is replaced with methacrylate; triallyl cyanurate; and triallyl trimellitate.

Examples of a polymerization initiator for use in manufacturing the vinyl polymer of the present invention include: 2,2'-azobisisobutyronitrile, 2,2'-azobis(4-methoxy-2,4-dimethylvaleronitrile), 2,2'-azobis(2,4-dimethylvaleronitrile), 2,2'-zobis(2-methylbutyronitrile), dimethyl-2,2'-azobisisobutylate, 1,1'-azobis(1-cyclohexane carbonitrile), 2-(carbamoyl azo)-isobutyronitrile, 2,2'-azobis(2,4,4-trimethyl pentane), 2-phenyl azo-2,4-dimethyl-4-methoxyvaleronitrile, 2,2'-azobis(2-methyl-propane), ketone peroxides such as methyl ethyl ketone peroxide, acetyl acetone peroxide, and cyclohexanone peroxide, 2,2-bis(t-butyl peroxy)butane, t-butyl hydroperoxide, cumene hydroperoxide, 1,1,3,3-tetramethyl butyl hydroperoxide, di-t-butyl peroxide, t-butyl cumyl peroxide, di-cumyl peroxide, ∝,∝'-bis(t-butyl peroxyisopropyl)benzene, isobutyl peroxide, octanoyl peroxide, decanoyl peroxide, lauroyl peroxide, 3,5,5-trimethyl hexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethyoxy ethyl peroxycarbonate, di-methoxyisopropyl peroxydicarbonate, di(3-methyl-3-methoxybutyl) peroxycarbonate, acetylcyclohexyl sulfonyl peroxide, t-butyl peroxyacetate, t-butyl peroxyisobutylate, t-butyl peroxyneodecanoate, t-butyl peroxy-2-ethyl hexanoate, t-butyl peroxylaurate, t-butyl peroxybenzoate, t-butyl peroxyisopropyl carbonate, di-t-butyl peroxyisophthalate, t-butyl peroxyallyl carbonate, t-amyl peroxy-2-ethyl hexanoate, di-t-butyl peroxyhexahydroterephthalate, and di-t-butyl peroxyazelate.

In a monomer comprising the polyester unit of "a resin having at least a polyester unit and the carboxyl group", a polyvalent alcohol and a polyvalent carboxylic acid, a polyvalent carboxylic anhydride, or a polyvalent carboxylic ester can be used as a material monomer.

Concretely, examples of a bivalent alcohol component include: alkylene oxide adducts of a bisphenol A such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl) propane, and polyoxypropylene(6)-2,2-bis(4-hydroxyphenyl) propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, bisphenol-A, and hydrogenated bisphenol-A.

Examples of a trivalent or more-valued alcohol component include sorbitol, 1,2,3,6-hexane tetrol, 1,4-sorbitan, pentaerythritol, dipentaerythritol, tripentaerythritol, 1, 2, 4-butanetriol, 1, 2, 5-pentanetriol, glycerol, 2-methylpropane triol, 2-methyl-1,2,4-butanetriol, trimethylol ethane, trimethylol propane, and 1,3,5-trihydroxymethyl benzene.

Examples of a bivalent carboxylic acid component include: aromatic dicarboxylic acids such as a phthalic acid, isophthalic acid, and terephthalic acid or an anhydride thereof; alkyl dicarboxylic acids such as a succinic acid, adipic acid, sebacic acid, and azelaic acid or an anhydride thereof; a succinic acid substituted by an alkyl group having 6 to 12 carbon atoms, or an anhydride thereof; unsaturated dicarboxylic acids such as a fumaric acid, maleic acid, and citraconic acid, or an anhydride thereof; n-dodecenyl succinic acid and isododecenyl succinic acid.

Especially, a bisphenol derivative is used as a diol component and a carboxylic acid component consisting of a bivalent carboxylic acid component or an anhydride thereof or lower alkyl ester thereof (e.g., fumaric acid, maleic acid, maleic anhydride, phthalic acid, terephthalic acid) is used as an acid component, and these components are subjected to condensation polymerization to obtain a polyester unit. It is preferable to use the polyester unit to exhibit a satisfactory charge property.

Examples of a trivalent or more-valued carboxylic acid component for forming a polyester unit having a crosslinking site include 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, or anhydrides and ester compounds thereof.

The amount of the trivalent or more-valued carboxylic acid component to be used is preferably 0.1 to 1.9 mol % based on the amount of total monomers.

Moreover, the resin having a carboxyl group and a polyester unit is preferably any resin selected from:

(a) a hybrid resin having a carboxyl group, (b) a polyester resin having a carboxyl group, and (c) a mixture of a hybrid resin having a carboxyl group and a polyester resin having a carboxyl group.

Examples of the binder resin in the toner of the present invention may include a mixture of the polyester resin and a vinyl-based polymer, a mixture of the hybrid resin and a vinyl-based polymer, and a mixture of the polyester resin, the hybrid resin, and a vinyl-based polymer.

Furthermore, the resin having a carboxyl group and a polyester unit preferably has an acid value in the range of 0.1 to 50 mgKOH/g. In general, an amount of a carboxyl group existing in a resin can be estimated with the acid value of the resin. The larger the amount of a carboxyl group, the larger the acid value. Contrarily, the smaller the amount of a carboxyl group, the smaller the acid value.

In the case where the acid value is less than 0.1 mgKOH/g, the resin crosslinking reaction hardly proceeds even if the epoxy value of the vinyl resin having an epoxy group is large, and thus the hot offset resistance tends to decrease. In such a case, use of a vinyl resin having an epoxy group with a high epoxy value can compensate for the poor crosslinking reaction to some degree.

On the other hand, in the case where the acid value of the resin exceeds 50 mgKOH/g, hygroscopicity of the binder resin increases, so that toner-charge release is greater than toner-charge generation. Consequently, problems such as toner scattering in a machine and ground fogging take place.

In the present invention, a combination of a vinyl resin having an epoxy group and a hybrid resin having a carboxyl group is most preferable as the binder resin because dispersibility of the wax is excellent and because the low-temperature fixability and the hot offset resistance can be improved and made compatible with each other.

The hybrid resin to be used in the present invention means a resin in which a vinyl-based polymer unit and a polyester unit are chemically bonded to each other. Specifically, the hybrid resin is a resin formed by an ester exchange between polyester and an ester structure site of a monomer such as an acrylate present in a vinyl-based polymer. Preferably, the hybrid resin is a graft copolymer (or block copolymer) in which a vinyl-based polymer serves as a backbone polymer and a polyester unit serves as a branch polymer.

In the case where a hybrid resin is produced, it is preferable to synthesize one or both of a vinyl-based polymer unit and a polyester unit by using a monomer capable of reacting with both the units. Examples of a monomer capable of reacting with the vinyl-based polymer unit and including monomers comprising the polyester unit include unsaturated dicarboxylic acids such as phthalic acid, maleic acid, citraconic acid, and itaconic acid, and anhydrides thereof. Examples of a monomer capable of reacting with the polyester unit include a vinyl-based monomer having a carboxyl group or a hydroxyl group, such as acrylic acids or methacrylic acids.

In addition to each of the above vinyl-based monomers capable of reacting with the polyester unit, a vinyl-based monomer that can be used when obtaining a vinyl resin having an epoxy group can be used similarly as a vinyl-based monomer that can be used for obtaining the vinyl-based polymer unit in the hybrid resin.

Examples of a method for producing with which a hybrid resin can be prepared include methods for producing shown in the following items (1) to (5).

(1) After a vinyl-based polymer and a polyester resin are separately produced, the vinyl-based polymer and the polyester resin are dissolved and swelled in a small amount of organic solvent. Then, an esterification catalyst and alcohol are added to the solution, and the whole is heated to carry out an ester exchange reaction for synthesizing a hybrid resin.

(2) After a vinyl-based polymer is produced, a polyester resin and a hybrid resin component are produced in the presence of the vinyl-based polymer. The hybrid resin component is produced through a reaction between a vinyl-based polymer (a vinyl-based monomer may be added as required) and one or both of a polyester monomer (such as alcohol or a carboxylic acid) and the polyester resin. An organic solvent may be appropriately used in this case as well.

(3) After a polyester resin is produced, a vinyl-based polymer and a hybrid resin component are produced in the presence of the polyester resin. The hybrid resin component is produced through a reaction between a polyester unit (a polyester monomer may be added as required) and a vinyl-based monomer.

(4) After a vinyl-based polymer and a polyester resin are produced, one or both of a vinyl-based monomer and a polyester monomer (such as alcohol or a carboxylic acid) is added in the presence of these polymer units to produce a hybrid resin component. An organic solvent may be appropriately used in this case as well.

(5) A vinyl-based monomer and a polyester monomer (such as alcohol or a carboxylic acid) are mixed, and the mixture is continuously subjected to an addition polymerization reaction and a condensation polymerization reaction to produce a vinyl-based polymer unit, a polyester resin, and a hybrid resin component. Furthermore, an organic solvent may be appropriately used.

Furthermore, after a hybrid resin component is produced by each of the methods for producing described in the items (1) to (4), a vinyl-based polymer and a polyester resin may be added to the component by adding one or both of a vinyl-based monomer and a polyester monomer (such as alcohol or a carboxylic acid) to carry out one or both of an addition polymerization reaction and a condensation polymerization reaction.

In each of the methods for producing described in the items (1) to (5), multiple polymer units different in molecular weight and in degree of crosslinking may be used for the vinyl-based polymer and the polyester unit.

An epoxy group of the vinyl resin (A) having the epoxy group and a carboxyl group of the resin (B) having at least a polyester unit and the carboxyl group can be reacted, for example, by heating the groups to a temperature equal to or greater than 100° C., and the reaction results in the formation of a bond such as that shown below. In the present invention, when melting and kneading the vinyl resin (A), the resin (B), the colorant, and the like, it is preferable to react the groups to form a crosslink.

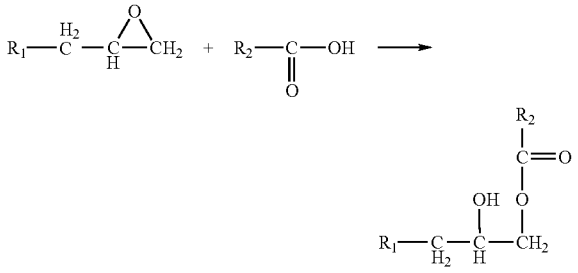

When the epoxy group reacts with the carboxyl group to form a crosslinked structure, viscosities of the resins in molten states increase upon kneading. Therefore, progress in the reaction between the epoxy group and the carboxyl group can be checked by observing the viscosity of the kneaded product.

Furthermore, in the present invention, in a molecular weight distribution measured by gel permeation chromatography (GPC) of tetrahydrofuran (THF) soluble matter of the toner, it is preferable that a number average molecular weight (Mn) be in the range of 1,000 to 5,000 and a weight average molecular weight (Mw) be in the range of 10,000 to 5,000,000.

Molecular weights within the above ranges in a chromatogram of GPC of the THF soluble matter of the toner to be used in the present invention enable the toner to retain proper charge amount and fixability, and thus satisfactory durability can be achieved.

In the case where the number average molecular weight is less than 1,000 or the weight average molecular weight is less than 10,000, a melt viscosity of the toner is excessively low, resulting in insufficient hot offset resistance upon fixing. In addition, dispensability of the colorant in the toner particles deteriorates, and transparency of an OHP image can become insufficient. Moreover, a charge control agent or the like is insufficiently dispersed to provide an uneven charge distribution, and fogging or the like occurs to reduce developability and durability.

In the case where the number average molecular weight exceeds 5,000 or the weight average molecular weight exceeds 5,000,000, the melt viscosity is excessively high, so that exudation of the wax to the toner surface upon fixing is blocked, thereby low-temperature fixability and offset resistance of the toner can be inferior.

Furthermore, in the present invention, in the molecular weight distribution measured by GPC of the THF soluble matter of the toner, there is a main peak preferably in the molecular weight range of 1,000 to 15,000, and more preferably in the molecular weight range of 1,500 to 4,000.

In the case where the toner has a main peak in the molecular weight range below 1,000, the melt viscosity of the toner decreases, and dispersability of materials in toner particles decreases to provide an uneven charge distribution. As a result, fogging or the like occurs, thereby developability and durability of the toner can be inferior. In the case where the toner has a main peak in the molecular weight range in excess of 15,000, the dispersability of the colorant decreases, reproducibility can be inferior.

A wax used in the toner of the present invention is described.

Examples of the wax used in the present invention: an aliphatic hydrocarbon-based wax such as low molecular weight polyethylene, low molecular weight polypropylene, olefin copolymers, micro crystalline wax, paraffin wax, and Fischer-Tropsch wax; oxide of an aliphatic hydrocarbon-based wax such as polyethylene oxide wax; a wax comprised of an ester of fatty acid mainly such as carnauba wax, behenyl behenate, montanic acid ester wax; and waxes such as deoxidized carnauba wax in which the ester of fatty acid is partly or fully deoxidized.

Furthermore, the examples further include: saturated normal chain fatty acids such as palmitic acid, stearic acid, montanoic acid; unsaturated fatty acids such as brassidic acid, eleostearic acid, and parinaric acid; saturated alcohols such as stearyl alcohol, aralkyl alcohol, behenyl alcohol, carnaubyl alcohol, seryl alcohol, melissyl alcohol; polyhydric alcohols such as sorbitol; aliphatic amides such as linoleic acid amide, oleic acid amide, and lauric acid amide; saturated aliphatic bisamides such as methylenebis stearic acid amide, ethylenebis capric acid amide, ethylenebis lauric acid amide, and hexamethylenebis stearic acid amide; unsaturated aliphatic amides such as ethylenebis oleic acid amide, hexamethylenebis oleic acid amide, N,N'-dioleyl adipic acid amide, and N, N'-dioleyl sebacic acid amide; aromatic bisamides such as m-xylenebis stearic acid amide, and N,N'-distearyl isophthalic acid amide; aliphatic metallic salts (generally known as metallic soap) such as calcium stearate, calcium laurate, zinc stearate, and magnesium stearate; waxes prepared by grafting an aliphatic hydrocarbon-based wax using a vinyl-based monomer such as styrene or acrylic acid; partially esterificated material of a fatty acid such as behenic acid monoglyceride and a polyhydric alcohol; and a methylester compound having a hydroxyl group obtained by adding hydrogen to the vegetable oil.

The particularly preferred wax to be used in the present invention is an aliphatic hydrocarbon-based wax. Preferred examples of the wax include: a low-molecular-weight hydrocarbon obtained by radical polymerization of an alkylene under a high pressure or by polymerization of an alkylene with a Ziegler catalyst or a metallocene catalyst under a low pressure; Fisher-Tropsch wax synthesized from coal or natural gas; an olefin polymer obtained by heat decomposition of a high-molecular-weight olefin polymer; and a synthetic hydrocarbon wax obtained from a distillation residue of a hydrocarbon obtained from a synthetic gas containing carbon monoxide and hydrogen by the Arge method, or a synthetic hydrocarbon wax obtained by hydrogenation thereof.

Furthermore, a hydrocarbon wax after fractionation by using press-sweating method, solvent processing method, vacuum distillation, or fractional crystallization system is more preferably used. A wax synthesized by a method not using polymerization of an alkylene is particularly preferable because of its favorable molecular weight distributions.

In an endothermic curve in differential scanning calorimetry of the toner of the present invention, the toner using those wax compositions has one or plural endothermic peaks in the temperature range of 30 to 200° C., and a maximum value of the largest endothermic peak of the endothermic peaks is preferably in the temperature range of 60 to 105° C. Furthermore, the maximum value of the largest endothermic peak of the endothermic peaks is more preferably in the temperature range of 70 to 100° C. The maximum value of the toner can be adjusted depending on the kind and amount of the wax to be used.

In the case where the maximum value of the largest endothermic peak is in the temperature range below 60° C., the wax melts to the toner surface when the toner is left under a high temperature environment. Thus, the blocking resistance substantially deteriorates, and a fused material may firmly adhere to a drum. Moreover, the small melting and exudation amount of the wax upon high temperature fixing may impair the hot offset resistance. On the other hand, in the case where the maximum value of the largest endothermic peak is in the temperature range above 105° C., the wax can not rapidly shift toward the molten toner surface upon low-temperature fixing, and hot offset can occur easily.

In the present invention, an available charge control agent to be comprised in the toner may be any of those known in the art.

Examples of a negative charge control agent include a metallic compound of salicylic acid, a metallic compound of naphthoic acid, a metallic compound of dicarboxylic acid, a high-molecular compound having sulfonic acid or carboxylic acid in the side chain, a boron compound, a urea compound, a silicon compound, and a calixarene. In particular, a metallic compound of an aromatic carboxylic acid is preferred because it has no color, has a high toner charge speed, and can maintain a constant charge amount stably.

Examples of a positive charge control agent include a quaternary ammonium salt, a high-molecular compound having the quaternary ammonium salt in the side chain, a guanidine compound, and an imidazole compound. In particular, aluminium 3,5-di-tert-butylsalicylate is preferred because it exhibits rapid rise of charge amount. The charge control agent may be added to toner particles internally or externally. The amount of the charge control agent to be added is preferably 0.5 to 10 parts by mass with respect to 100 parts by mass of a binder resin.

In the present invention, an available flowability improving agent to be externally added to the toner particles may be any of those known in the art. External addition of the flowability improving agent can improve image quality and can enhance the shelf life under a high temperature environment. Any flowability improving agent can be used as long as flowability after addition of the flowability improving agent to a classified product as the toner particles can be higher than that prior to the addition. Preferable examples of the flowability improving agent include: fluorine-based resin powders such as a vinylidene fluoride fine powder and a polytetrafluoroethylene fine powder; and inorganic fine powders such as wet-process silica, dry-process silica, titanium oxide, and aluminum oxide.

An example of the dry-process silica is a fine powder produced by vapor-phase oxidation of a silicon halogen compound, which is called dry silica or fumed silica and which is produced by conventionally known techniques. An example of the known techniques utilizes a thermal decomposition oxidation reaction in oxyhydrogen flame of silicon tetrachloride gas. A basis for the reaction is shown in a following reaction formula.

$$SiCl_4+2H_2+O_2 \rightarrow SiO_2+4HCl$$

In this production process, a metal halogen compound such as aluminum chloride or titanium chloride can be used in combination with a silicon halogen compound to yield composite fine powders of silica and other metallic oxides, and the composite fine powders are also included in the example. With regard to a particle size of the silica fine powder, an average primary particle size thereof is preferably within the range of 0.001 to 2 μm. It is particularly preferable to use a silica fine powder with an average primary particle size within the range of 0.002 to 0.2 μm.

In addition, the inorganic fine powder is preferably hydrophobed with a hydrophobing agent. Examples of the hydrophobing agent include: coupling agents such as a silane coupling agent, a titanate coupling agent, an aluminum coupling agent, and a zircoaluminate coupling agent; and a silicone oil.

Specific examples of the silane coupling agent include hexamethyldisilazane, vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane. The amount of the hydrophobed inorganic powder is preferably 1 to 60 parts by mass, more preferably 3 to 50 parts by mass based on 100 parts by mass of the inorganic unhydrophobed powder.

Furthermore, a dimethyl silicone oil is preferable as the silicone oil.

In particular, it is more preferable to use a treated silica fine powder obtained by subjecting a silica fine powder produced by vapor-phase oxidation of the silicon halogen compound to hydrophobing treatment. In the treated silica fine powder, the silica fine powder is more preferably treated to show a methanol hydrophobic degree in the range of 30 to 80.

Furthermore, the flowability improving agent to be used in the present invention may be treated with a coupling agent having an amino group.

The amount of the flowability improving agent to be used in the present invention is 0.01 to 8 parts by mass, preferably 0.1 to 4 parts by mass with respect to 100 parts by mass of the toner particles.

Examples of the colorant to be used in the toner of the present invention include the following.

Although the toner of the present invention is preferably used for a toner for color image formation because of its excellent color mixing property and transparency, the toner of the present invention is not limited to the toner for color image formation.

Examples of a black colorant include carbon black, a magnetic material, magnetite, and a material in which the color thereof is adjusted to black with the following yellow, magenta, and cyan colorants.

Examples of the yellow colorant include a condensation azo compound, an isoindolinone compound, an anthraquinone compound, an azo metal complex, a methine compound, and an allylamide compound. Specifically, preferred examples of the yellow colorant include C. I. Pigment Yellow 12, 13, 14, 15, 17, 62, 74, 83, 93, 94, 95, 97, 109,110, 111, 120, 127, 128, 129, 147, 155, 168, 174, 176, 180, 181, and 191.

Examples of the magenta colorant include a condensation azo compound, a diketopyrrolopyrrole compound, anthraquinone, a quinacridone compound, a basic dye lake compound, a naphthol compound, a benzimidazolone compound, a thioindigo compound, and a perylene compound. Specifically, particularly preferred examples of the magenta colorant include: C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, and 254; and C. I. Pigment Violet 19.

Preferred examples of the cyan colorant to be used include C.I. Pigment Blue 1, 7, 15, 15:1, 15:2, 15:3, 15:4, 60, 62, and 66. Of those, C.I. Pigment Blue 15:3 is particularly preferred because it has excellent coloring ability and transparency of an OHP image.

Examples of the magnetic material include a metallic oxide containing an element such as iron, cobalt, nickel, copper, magnesium, manganese, aluminum, or silicon. Among them, a magnetic material mainly containing an iron oxide such as black iron oxide or γ-iron oxide is preferable. The magnetic material may contain a metallic element such as a silicon element or an aluminum element from the standpoint of controlling chargeability of the toner. Particles of such magnetic materials have a BET specific surface area by nitrogen adsorption of preferably 2 to 30 $m^2/g$, particularly preferably 3 to 28 $m^2/g$, and have a Mohs hardness of preferably 5 to 7.

Examples of the shape of the magnetic material include an octahedral shape, a hexahedral shape, a spherical shape, a needle shape, and a scaly shape. The magnetic material preferably has a shape with a low degree of anisotropy such as the octahedral shape, the hexahedral shape, or the spherical shape in order to increase an image density. The average particle size of the magnetic material is preferably 0.05 to 1.0 μm, more preferably 0.1 to 0.6 μm, and still more preferably 0.1 to 0.4 μm.

The content of the magnetic material is 30 to 200 parts by mass, preferably 40 to 200 parts by mass, and more preferably 50 to 150 parts by mass with respect to 100 parts by mass of the binder resin. If the content is less than 30 parts by mass, in a developing unit utilizing a magnetic force for carrying a toner, the toner carrying ability of the unit decreases. Thus, unevenness tends to occur in a developer layer on a toner carrier to result in image unevenness. Moreover, a decrease in the image density tends to easily occur owing to an increase in the triboelectrification of a magnetic toner. On the other hand, if the content exceeds 200 parts by mass, a problem tends to arise in terms of fixability.

The toner of the present invention can be used for nonmagnetic one-component development. Furthermore, in the case where the toner of the present invention is used for a two-component developer, the toner is mixed with a magnetic carrier before use.

Examples of an available magnetic carrier include known magnetic carriers such as a magnetic particle itself, a coated carrier obtained by coating a magnetic particle with a resin, and a magnetic material dispersed resin carrier obtained by dispersing a magnetic particle in a resin particle. Examples of an available magnetic particle for a carrier include: surface-oxidized or -unoxidized metallic particles such as iron, lithium, calcium, magnesium, nickel, copper, zinc, cobalt, manganese, chromium, and rare earths; and alloy particles, oxide particles thereof, and ferrites.

The above coated carrier obtained by coating the surface of a magnetic carrier particle with a resin is particularly preferable for use in a developing method in which an AC bias is applied to a developing sleeve. Examples of an applicable coating method include conventionally known methods such as: a method in which a coating liquid prepared by dissolving or suspending a coating material such as a resin in a solvent is allowed to adhere to the surface of a magnetic carrier core particle; and a method in which a magnetic carrier core particle and a coating material are mixed in powder form.

Examples of the coating material for the surface of the magnetic carrier core particle include a silicone resin, a polyester resin, a styrene-based resin, an acrylic resin, polyamide, polyvinyl butyral, and an aminoacrylate resin. One or plural of those resins are used. The coating amount of the above coating material is preferably 0.1 to 30% by mass (more preferably 0.5 to 20% by mass) with respect to the carrier core particle. Those magnetic carrier core particles have an average particle size of preferably 10 to 100 μm, more preferably 20 to 70 μm.

In the case where the toner of the present invention and a magnetic carrier are mixed to prepare a two-component developer, a mixing ratio of the toner of the present invention and the magnetic carrier is 2 to 15% by mass, preferably 4 to 13% by mass in terms of a toner concentration in the developer. A toner concentration within such a range ordinarily provides a satisfactory result. A toner concentration of less than 2% tends to reduce the image density, whereas a toner concentration in excess of 15% tends to cause fogging or scattering in a machine.

A weight average particle size of the toner of the present invention is preferably 3 to 11 μm. The weight average particle size is more preferably 3 to 9 μm from the viewpoint of obtaining a high-quality image.

In the toner of the present invention, an average circularity of particles each having a circle-equivalent diameter of 2 μm or more in the toner is in the range of 0.920 to 0.945, preferably in the range of 0.922 to 0.943.

If the average circularity is less than 0.920, transferability is poor, and as a result, an image with high graininess may be obtained. Contrarily, if the average circularity is greater than 0.945, in cleaning of a photosensitive drum, the shapes of the particles are so close to spherical shapes that the particles may pass through a cleaning blade, causing detrimental effects on the obtained image due to faulty cleaning.

The average circularity of the toner of the present invention can be adjusted by using a surface modifying device to be described later.

Next, procedures for manufacturing a toner are described. A toner of the present invention can be manufactured by melting and kneading a binder resin, a colorant, a wax, and such other arbitrary material, cooling and pulverizing the kneaded product, rounding and classifying the pulverized products as required, followed by mixing in of the above-described flowability improving agent.

First, in a raw material mixing step, predetermined amounts of at least resin and a colorant are weighted, and then compounded and mixed together by a mixing device as agents to be internally added to the toner. Examples of the mixing device include a DOUBLE CON mixer, a V-type mixer, a drum-type mixer, a SUPER mixer, a HENSCHEL mixer, and a NAUTA mixer.

Further, the toner raw materials compounded and mixed as described above are melted and kneaded to melt the resin, and the colorant and the like are dispersed in the melted resin. In the melting and kneading step, for example, a batch kneader such as a pressure kneader, a BANBURY mixer, etc. or a continuous kneader can be used. Recently, due to the advantage of allowing continuous production, a single-screw or twin-screw extruder is becoming mainstream. For example, a KTK series twin-screw extruder from Kobe Steel Ltd., a TEM series twin-screw extruder from Toshiba Machine Co., Ltd., a twin-screw extruder from KCK Corporation, a co-kneader from Buss Co., Ltd, and the like are generally used. A colored resin composition obtained by melting and kneading the toner raw materials is rolled out by two rolls or the like after the melting and kneading step, and then cooled through a cooling step of cooling the composition by water cooling or the like.

Subsequently, the resulting cooled product of the colored resin composition obtained as described above is usually pulverized into a predetermined particle size by a pulverizing step. In the pulverizing step, first, the colored resin composition is roughly pulverized with a crusher, a hammer mill, a feather mill, or the like, followed by further pulverizing with a CRIPTRON system from Kawasaki Heavy Industries, Ltd., a SUPER ROTOR from Nisshin Engineering, or the like, Subsequently, the pulverized products are classified by using a screen classifier, for example, a classifier such as an ELBOW-JET classifier (from Nittesu Mining Co., Ltd.) employing an inertia classification system, a TURBOPLEX classifier (from Hosokawa Micron Corporation) employing a centrifugal classification system, etc., to obtain toner particles having weight-average particle sizes in the range of 3 to 11 μm.

As required, surface modification and rounding are performed in the surface modification step by using, for example, a HYBRITIZATION system from Nara Machine Co., Ltd., or a MECHANOFUSION system from Hosokawa Micron Corporation.

According to the present invention, it is preferable that no mechanical pulverizing be performed in the pulverizing step, and that a device that performs classification and surface modification treatment using a mechanical impact force be used after pulverizing with an air jet type pulverizing machine to thereby obtain classified products having weight-average particle sizes in the range of 3 to 11 μm. The surface modification treatment and the classification may be performed separately, in which case a screen classifier such as HIBOLTA that is a wind screen (from Shin Tokyo Kikai Corporation) may be used. In addition, examples of a method of externally adding external additives include compounding predetermined amounts of the classified toner and known various external additives and then stirring and mixing them by using as an external adding machine a high-speed stirrer that applies a shearing force to powder, such as a Henschel mixer, a Super mixer, or the like.

FIG. 1 shows an example of a surface modifying device used in the present invention.

The surface modifying device shown in FIG. 1 comprises: a casing 55; a jacket (not shown) through which cooling water and an antifreezing fluid can pass; a classifying rotor 41 as classifying means for classifying between particles having sizes larger than a predetermined particle size and fine particles having sizes smaller than the predetermined particle size; a dispersing rotor 46 as surface treatment means for treating the surface of the above-mentioned particles by applying a mechanical impact to the particles; liners 44 arranged circumferentially on an outer periphery of the dispersing rotor 46 at a predetermined interval; a guide ring 49 as guiding means for guiding, from among the particles classified by the classifying rotor 41, the particles having sizes larger than the predetermined size to the dispersing rotor 46; a discharge port for collecting fine powders 42 as discharging means for discharging, from among the particles classified by the classifying rotor 41, the fine particles having sizes smaller than the predetermined particle size to the outside; a cold air introduction port 45 as particle circulation means for sending the particles having their surfaces treated by the dispersing rotor 46 to the classifying rotor 41; a raw material supply port 43 for introducing the treated particles into the casing 55; and a powder discharge port 47 and a discharge valve 48, which are openable and closable, for discharging the surface-treated particles from the casing 55.

The classifying rotor 41 is a cylindrical rotor and is provided on one end surface side inside the casing 55. The fine powder collection discharge port 42 is provided on one end portion of the casing 55 so that particles present inside the classification rotor 41 are discharged therefrom. The raw material supply port 43 is provided in a central portion of a circumferential surface of the casing 55. The cold air introduction port 45 is provided on the other end surface side on the circumferential surface of the casing 55. The powder discharge port 47 is provided on the circumferential surface of the casing 55 at a position opposite to the raw material supply port 43. The discharge valve 48 is a valve capable of freely opening and closing the powder discharge port 47.

Figure 2:
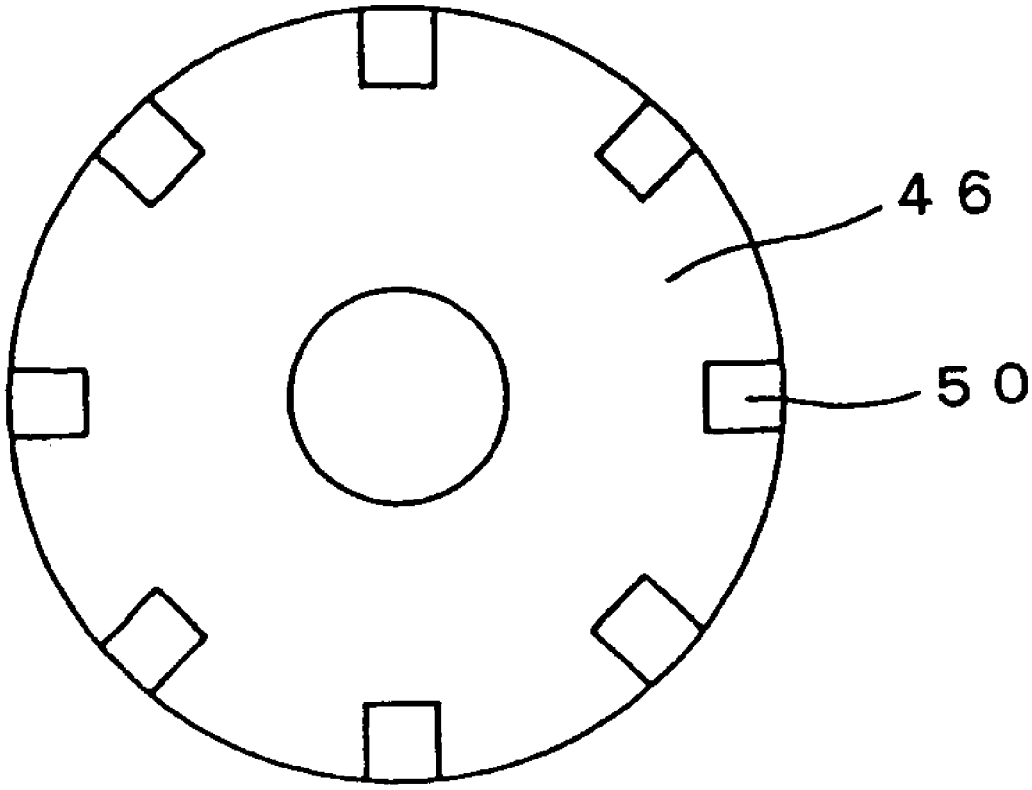
FIG. 2 is a diagram showing how a dispersing rotor shown in FIG. 1 and an arrangement of square disks provided thereon.

The dispersing rotor 46 and the liners 44 are provided between the cold air introduction port 45 and the raw material supply port 43 and between the cold air introduction port 45 and the powder discharge port 47, respectively. The liners 44 are arranged circumferentially along an inner peripheral surface of the casing 55. As shown in FIG. 2, the dispersing rotor 46 comprises a circular disk and plural square disks 50 arranged on normal to the circular disk along the outer edge of the circular disk. The dispersion rotor 46 is provided on the other end surface side of the casing 55 and arranged such that a predetermined gap is formed between each liner 44 and each square disk 50. The guide ring 49 is provided in the central portion of the casing 55. The guide ring 49 is a cylindrical member provided so as to extend from a position where it covers a part of the outer peripheral surface of the classifying rotor 41 to the vicinity of the classifying rotor 41. By means of the guide ring 49, the interior of the casing 55 is divided into a first space 51 sandwiched between the outer peripheral surface of the guide ring 49 and the inner peripheral surface of the casing 55, and a second space 52 defined inside the guide ring 49.

Note that the dispersing rotor 46 may include cylindrical pins instead of the square disks 50. While in this embodiment each liner 44 has a large number of grooves provided on its surface opposing the square disk 50, the liner 44 used may not have such grooves on its surface. Also, the classifying rotor 41 may be installed either vertically as shown in FIG. 1 or horizontally. In addition, one classifying rotor 41 may be provided as shown in FIG. 1, or two or more classifying rotors 41 may be provided.

In the surface modifying device constructed as described above, when an article to be finely pulverized is introduced from the raw material supply port 43 with the discharged valve 48 being in the "closed" state, first, the introduced article to be finely pulverized is sucked in by a blower (not shown) and then subjected to classification by the classifying rotor 41. At this time, fine powders classified as having particle sizes equal to a predetermined particle size or smaller pass through the circumferential surface of the classifying rotor 41 to be introduced into the inside of the classifying rotor 41, and then continuously discharged and removed from the device to the exterior. Coarse powders having particle sizes equal to or larger than the predetermined particle size are carried on a circulation flow generated by the dispersion rotor 46 while moving along an inner periphery (second space 52) of the guide ring 49 due to a centrifugal force, to be introduced to the gap (hereinafter also referred to as the "surface modification zone") between the square disk 50 and the liner 44.

The powders introduced into the surface modification zone are subjected to surface modification by receiving a mechanical impact force between the dispersing rotor 46 and the liner 44. The surface-modified powder particles are carried on cold air passing through inside the machine, to be transported along the outer periphery (first space 51) of the guide ring 49 to reach the classifying rotor 41. By the classifying rotor 41, the fine powders are discharged to the outside of the machine whereas the coarse powders are returned again to the second space 52 where the surface modifying operation is repeated therefor. In this way, with the surface modifying device of FIG. 1, the classification of particles using the classifying rotor 41 and the surface treatment of the particles using the dispersing rotor 46 are repeated. Then, after a given period of time has elapsed, the discharge valve 48 is opened to collect the surface-modified particles from the discharge port 47.

Upon examination, the inventors of the present invention have found that a period of time until the opening of the discharge valve (cycle time) and the rotating rate of the dispersing rotor are important in controlling an average circularity of toner particles and an amount of wax present on the toner surface. To increase the average circularity, it is effective to make the cycle time longer or increase a peripheral speed of the dispersing rotor. Further, to restrain the amount of the releasing agent on the toner surface, conversely, it is effective to make the cycle time shorter or to lower the peripheral speed. Thus, from the viewpoint of appropriately adjusting the average circularity of toner particles and the amount of wax present on the toner surface, it is preferable that the above-mentioned peripheral speed is not lower than $1.2\times10^5$ mm/sec and the above-mentioned cycle time is within a range of 5 to 60 seconds.

An image forming apparatus of the present invention is an apparatus for forming an image by using the above-described toner of the present invention, and comprises a means for forming an unfixed toner image on a recording material and a means for fixing the toner image onto the recording material. In the present invention, the means for forming the unfixed toner image is not particularly limited; various known means may be employed as the means for forming the unfixed toner image.

Next, an image forming apparatus suitable for the present invention is described.

(1) Example of Image Forming Apparatus

Figure 3:
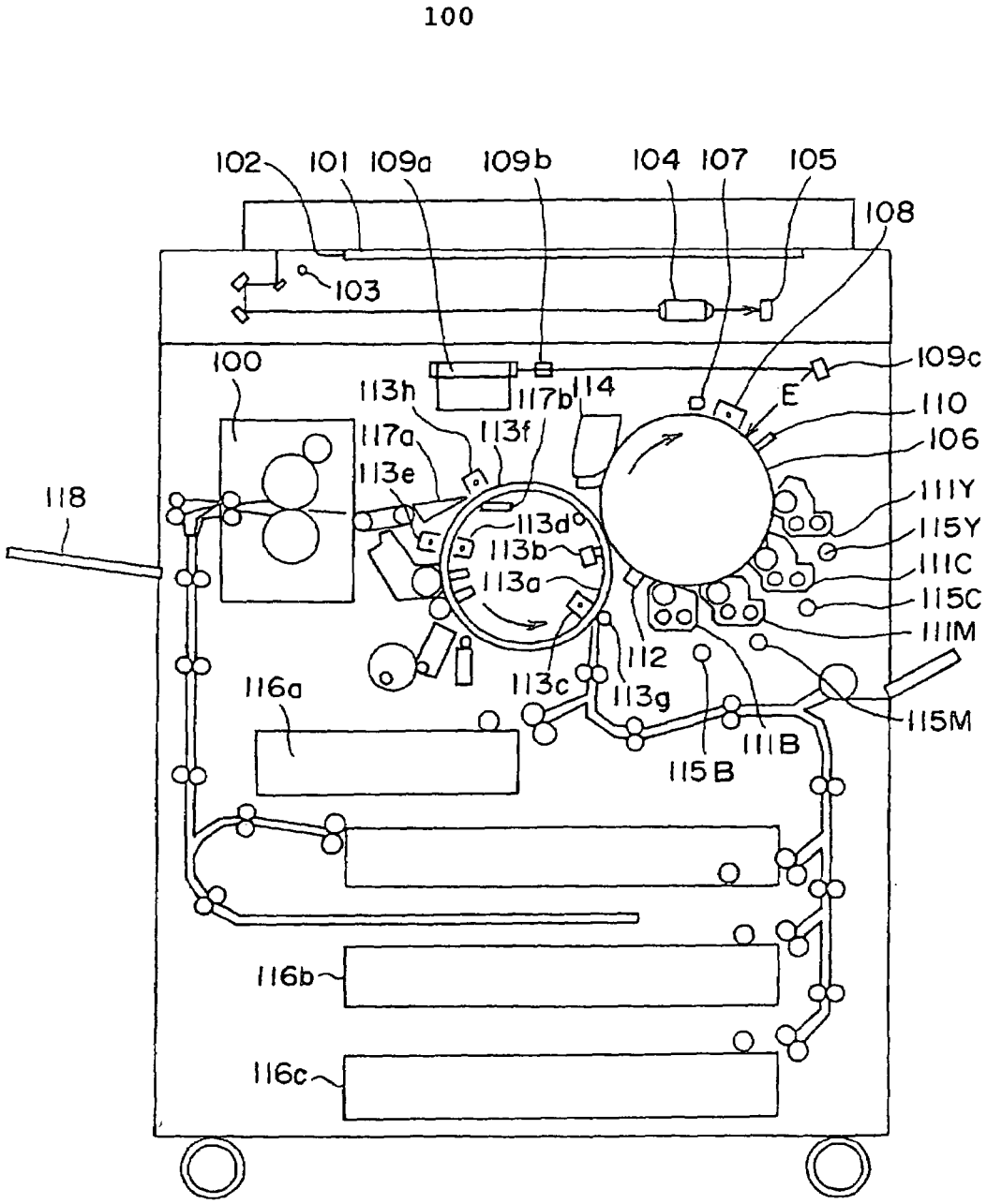
FIG. 3 is a diagram schematically showing a construction of an example of an image forming apparatus used in the present invention.

FIG. 3 is a diagram showing a schematic construction of one example of an image forming apparatus for forming a full color image by an electrophotographic method. The image forming apparatus shown in FIG. 3 is used as a full color copying machine or a full color printer. As shown in FIG. 3, when used as the full color copying machine, the image forming apparatus has a digital color image reader portion and a digital color image printer portion provided in an upper portion and a lower portion thereof, respectively.

In the image reader portion, a copy 101 is placed on a copy table glass 102 and then exposed to light by scanning with an exposure lamp 103, thus condensing reflected light images from the copy 101 by means of a lens 104 onto a full color sensor 105 to obtain a color separation image signal. The color separation image signal is subjected to processing by a video processing unit (not shown) after passing through an amplification circuit, and sent to the digital image printer portion.

In the image printer portion, a photosensitive drum 106 as an image bearing member includes a photosensitive layer having, for example, an organic photoconductor, and is retained so as to be rotatable in a direction of the arrow. Arranged around the photosensitive drum 106 are a pre-exposure lamp 107, a corona charger 108, a laser exposure optical system, a potential sensor 110, four developing units 111Y, 111C, 111M, and 111B for developing different colors, a means for detecting a quantity of light present on the drum 112, a transfer device, and a cleaning unit 114.

In the laser exposure optical system, the image signal from the reader portion is converted into an optical signal for image scan exposure by a laser output portion (not shown). The converted laser light is reflected by a polygon mirror 109*a* to be projected onto a surface of the photosensitive drum 1 through a lens 109*b* and a mirror 109*c*.

In the printer portion, at the time of image formation, the photosensitive drum 106 is rotated in the arrow direction, to eliminate charge by the pre-exposure lamp 107, and thereafter the photosensitive drum 106 is negatively charged by the charger 108 with uniformity. A light image E is then irradiated for each separation color to form an electrostatic charge image on the photosensitive drum 106.

Next, a predetermined developing unit is operated to develop the electrostatic charge image formed on the photosensitive drum 106, thus forming a toner image on the photosensitive drum 106 using toner. The developing units 111Y, 111C, 111M, and 111B alternately approach the photosensitive drum 106 according to the respective separation colors to thereby perform developing, due to the operation of their corresponding eccentric cams 115Y, 115C, 115M, and 115B, respectively.

The transfer device includes a transfer drum 113*a*, a transfer charger 113*b*, an attracting charger 113*c* for electrostatically attracting a recording material and an attracting roller 113*g* opposed to the attracting charger 113*c*, an inside charger 113*d*, an outside charger 113*e*, and a stripping charger 113*h*. The transfer drum 113*a* is axially supported so as to be capable of being rotationally driven, and a transfer sheet 13*f* serving as a recording material carrying member for carrying a recording material is stretched in tension integrally and in a cylindrical fashion on an opening region of a circumferential surface of the transfer drum 113*a*. As the transfer sheet 113*f*, a resin film such as a polycarbonate film is used.

The recording material is transported to the transfer drum 113*a* from a cassette 116*a*, 116*b*, or 116*c* after passing through a transfer sheet transporting system, to be carried on the transfer drum 113*a*. As the transfer drum 113*a* rotates, the recording material carried on the transfer drum 113*a* is repeatedly transported to a transfer position opposed to the photosensitive drum 106. As the recording material passes through the transfer position, the toner image on the photosensitive drum 106 is transferred to the recording material due to the operation of the transfer charger 113*b*.

The toner image may be directly transferred from the photosensitive member to the recording material. Alternatively, the toner image on the photosensitive member may also be transferred to an intermediate transfer member and then transferred to the recording material from the intermediate transfer member.

The image forming process described above is repeated for each of yellow (Y), magenta (M), cyan (C), and black (B), whereby a color image obtained by superimposing toner images of four different colors is formed on the recording material that is formed on the transfer drum 113*a*.

The recording material, having transferred thereon the toner images of four colors, is stripped from the transfer drum 113*a* due to the operations of a stripping claw 117*a*, a stripping lifting roller 117*b*, and the stripping charger 113*h*, and sent to a heat- and pressure-fixing unit 100 where the recording material is subjected to heat- and pressure-fixing so that color mixing, color developing, and fixation of the toner to the recording material are performed, thus fixing a full color image on the recording material. Then, the recording material is delivered to a tray 118, thereby completing formation of the fill color image.

(2) Example of Fixing Device

As the fixing means used in the image forming apparatus of the present invention using toner, there is employed a device using heating and pressurizing means having at least a rotatable heating member surrounded by a heat-resisting film and a pressurizing roller that serves as a pressurizing member, in which a nip portion is formed between the pressurizing roller and the heat-resisting film and the recording material is nipped and conveyed between the film and the pressurizing roller in the nip portion to heat a color toner image formed on the recording material, thereby forming a fixed image. Examples of such a fixing means include, for example, a fixing device of a so-called SURF fixing system and a fixing device of an IHF fixing system.

Figure 4:
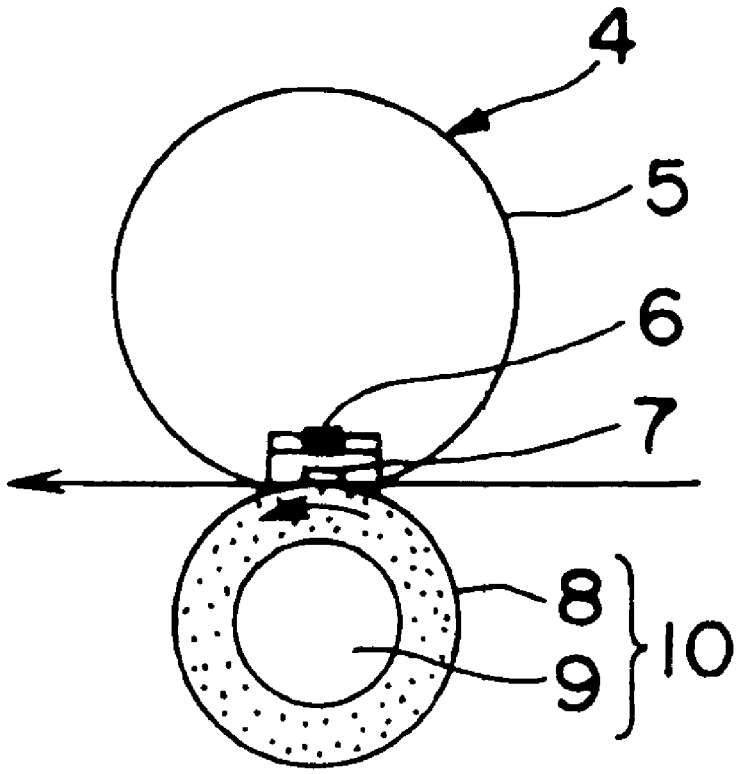
FIG. 4 is a schematic diagram showing an example of a fixing device used in the present invention.

FIG. 4 shows an example of a fixing device that realizes the SURF fixing system. The fixing device has a heating device 4 and a pressurizing roller 10 arranged opposed to the heating device 4. The heating device 4 has a cylindrical heat-resisting film 5 which is made of polyimide coated with a fluororesin and has a thickness of around 50 μm, a ceramic heater 7 as a heating member that is provided in the interior of the cylindrical heat-resisting film 5, and a temperature detecting element 6 such as a thermistor arranged in contact with the heater for adjusting a heating temperature. The pressurizing roller (pressurizing member) 10 has a cored bar 9 made of aluminum alloy, and a rubber roller 8 which is coated with a resin composition exhibiting excellent releasability and heat resistance such as a silicone resin and a fluororesin and is provided on the outside of a circumferential surface of the cored bar 9.

The pressurizing roller 10 is pushed toward a heating surface of the ceramic heater (heating means) 7 by a pushing means, for example, a not-shown spring. The heat-resisting film 5 is provided so as to be movable along an endless track (a circular track in the example of the drawing) passing the heating surface of the ceramic heater. The heat-resisting film 5 is nipped between the ceramic heater 7 and the pressurizing roller 10, forming a nip portion therebetween. A recording material having an unfixed toner image thereon is introduced to the nip portion to melt the toner on the recording material, thereby forming a fixed toner image on the recording material.

Figure 5:
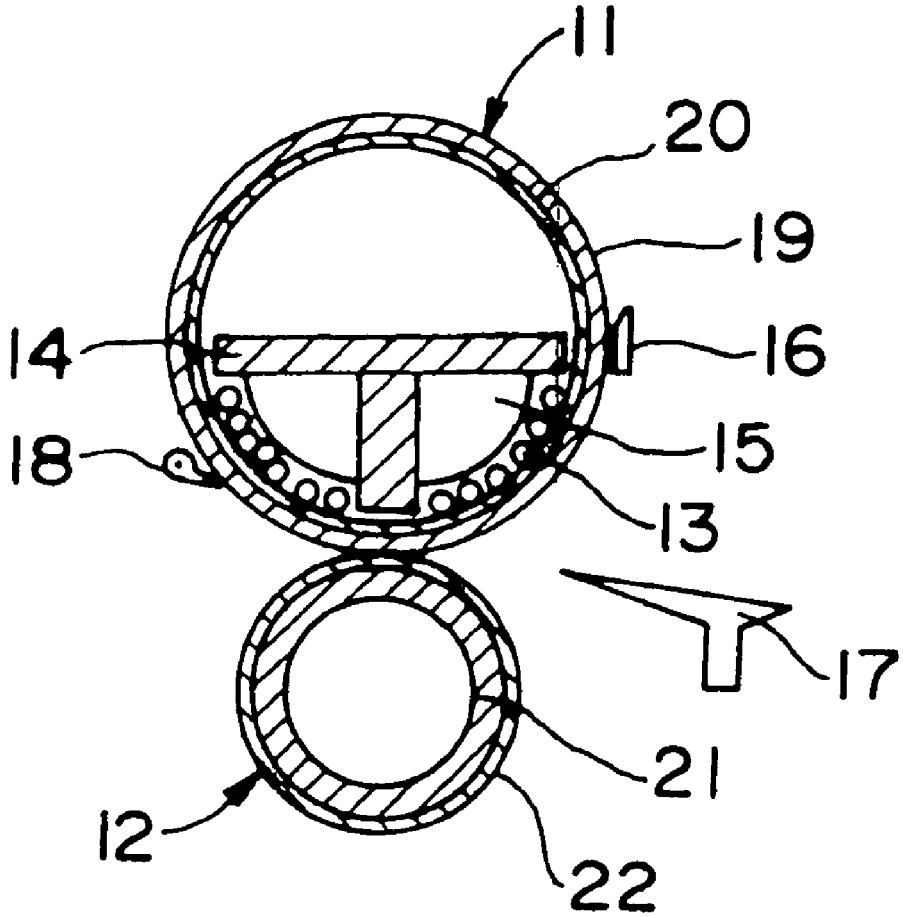
FIG. 5 is a schematic diagram showing another example of a fixing device used in the present invention.

FIG. 5 shows an example of a fixing device that realizes the IHF fixing system. The fixing device has a fixing belt 11 and a pressurizing roller (pressurizing member) 12 arranged opposed to the fixing belt 11. The fixing belt 11 has a metallic conductor 20 and an elastic layer 19 made of a fluororesin or the like and covering a surface of the metallic conductor 20. Excitation coils 13 are concentrically arranged in the interior of the fixing belt 11. Also arranged in the interior of the fixing belt 11 is a core 14 formed of a magnetic material and serving as a magnetic field blocking member for blocking magnetic fields. The pressurizing roller 12 has a hollow cored bar 21 made of aluminum alloy, and an elastic layer 22 having surface-releasability and heat resistance and covering the outside of a circumferential surface of the hollow cored bar 21.

The core 14 is supported by a pair of holders 15 each having a sectoral cross section. Each holder 15 is formed of a heat resistant resin such as PPS (polyphenylene sulfide), PEEK (polyetheretherketone), and phenol resin. The excitation coils 13 are formed by winding lead wires along a surface of each holder 15 from a central projection portion of the core 14 having a "T"-shaped cross section, so as to arrange the lead wires along an inner peripheral surface of the fixing roller.

The fixing belt 11 is arranged such that its surface is in contact with a temperature sensor 16. In addition, a transport guide 17 is arranged in a position for guiding the recording material having an unfixed toner image thereon to a press-contact portion (nip portion) between the fixing belt 11 and the pressurizing roller 12. Further, a stripping claw 18 is arranged in the rearward of the fixing device. The stripping claw 18 is arranged in contact or in proximity to the surface of the fixing belt 11 to prevent a recording material such as paper from being wound onto the fixing belt 11.

The pressurizing roller 12 is pushed toward the fixing belt 11 (core 14) by a pushing means, for example, a not-shown spring. The fixing belt 11 is provided so as to be movable along an endless track (a circular track in the example of the drawing) passing the surfaces of the excitation coils 13. At a position where the fixing belt 11 is opposed to the pressurizing roller 12, the fixing belt 11 is nipped between the core 14 and the pressurizing roller 12, forming a nip portion between the fixing belt 11 and the pressurizing roller 12. A recording material having an unfixed toner image thereon is introduced to the nip portion to melt the toner on the recording material, thereby forming a fixed toner image on the recording material.

Each excitation coil 13 generates high-frequency magnetic fields by flowing a high-frequency current therethrough, and an induction eddy current is generated in the fixing belt 11 by the magnetic field, so that the fixing belt 11 is subjected to Joule heating by means of the skin resistance of the fixing belt 11 itself. In the apparatus, the excitation coils and a series of devices used for flowing a high-frequency current to the excitation coils may be referred to as the heating means of the present invention. A temperature of the fixing belt 11 is automatically controlled to maintain a constant temperature by increasing or decreasing the power supply to the excitation coils 13 on the basis of a detection signal from the temperature sensor 16.

Further, by combining the core 14 consisting of a magnetic material with the excitation coils 13, high-frequency magnetic fields can be generated more efficiently. In particular, when, as shown in FIG. 5, the core having a "T"-shaped sectional configuration is used, a quantity of heat required of the fixing device can be generated with low power consumption due to effective concentration of high-frequency magnetic fields and a magnetic field blocking effect of blocking propagation of the magnetic fields to sections other than a heat generation section.

Examples of a material for an elastic layer for coating a film include a fluorine resin and a silicone resin. Specific examples of the material include a tetrafluoroethylene-perfluoroalkylvinylether copolymer (PFA), polytetrafluoroethylene (PTFE), polyvinyl fluoride (PVF), a vinylidene-fluoride-based fluorine rubber, a propylene-tetrafluoroethylene-based fluorine rubber, a fluorosilicone rubber, and a silicone rubber.

The thickness of the elastic layer is preferably 10 to 500 μm in order to prevent gloss unevenness due to the inability of the heating surface (release layer) to follow irregularities of the recording material or of the toner layer when printing an image.

A thickness of the elastic layer of less than 10 μm is not preferable. With the above thickness, the elastic layer can not exert a function as an elastic member, and a pressure distribution upon fixing can become uneven. Thus, an unfixed toner of a secondary color can not be sufficiently heat-fixed particularly upon full-color image fixing. As a result, unevenness can occur in a gloss of the fixed image. In addition, insufficient melting of the toner can degrade the color mixing property of the toner, thereby making it impossible to obtain a high-definition full-color image. A thickness of the elastic layer above 500 μm is not preferable either. With that thickness, thermal conductivity upon fixing can be inhibited to degrade a thermal following-up property on the fixing surface. Thus, a quick-start property can be impaired, and at the same time, fixing unevenness easily occurs.

Next, a preferable method of measuring each physical property of the color toner of the present invention is described below.

(Measurement of Molecular Weight of Toner by GPC)

As described below, a molecular weight distribution of the toner by GPC can be determined through measurement by GPC using THF soluble matter obtained by dissolving a sample as a measuring object in a THF solvent.

In other words, a sample is placed in THF, and the mixture is left for several hours. After that, the mixture is sufficiently shaken to mix the sample and THF (until a coalesced product of the sample disappears), and the mixture is left for an additional 12 or more hours. At this time, a time period during which the sample is left in THF should be 24 hours or more. Then, the mixture is passed through a sample treatment filter (having a pore size of 0.45 to 0.5 μm for example, MISHORIDISK H-25-5 manufactured by Tosoh Corporation or EKICRODISK 25 CR manufactured by Gelman Science Japan) to prepare a sample for GPC measurement. Moreover, the sample concentration is adjusted such that the amount of the resin component is 0.5 to 5 mg/ml.

GPC measurement of the sample prepared by the above method is as follows. A column is stabilized in a heat chamber at 40° C., and tetrahydrofuran (THF) to serve as a solvent is flown to the column stabilized at the temperature at a flow velocity of 1 ml/min. Then, about 50 to 200 μl of the THF sample solution of a resin adjusted to a sample concentration of 0.05 to 0.6% by mass is injected for measurement.

A combination of multiple commercially available polystyrene gel columns is recommended for the column in order to accurately measure a molecular weight region of $10^3$ to $2\times10^6$. Examples of the combination include: a combination of SHODEX GPC KF-801, 802, 803, 804, 805, 806, and 807 manufactured by Showa Denko; and a combination of μ-STYRAGEL 500, $10^3$, $10^4$, and $10^5$ manufactured by Waters. An RI (refractive index) detector is used as a detector.

In measuring a molecular weight of the sample, a molecular weight distribution of the sample is calculated from a relationship between a logarithmic value in a calibration curve created by several kinds of monodisperse polystyrene standard samples and a count number (retention time).

Examples of a standard polystyrene sample used for a calibration curve include a standard polystyrene sample having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, or $4.48\times10^6$ (manufactured by Tosoh Corporation or Pressure Chemical Co.). Preferably, at least about 10 standard polystyrene samples are used in combination.

(Measurement of Maximum Temperature of Largest endothermic Peak of Toner, Wax, etc.)

Temperature Curve:

Temperature rise I (from 30° C. to 200° C., rate of temperature increase 10° C./min)

Temperature decrease I (from 200° C. to 30° C., rate of temperature decrease 10° C./min)

Temperature rise II (from 30° C. to 200° C., rate of temperature increase 10° C./min)

The largest endothermic peaks of the toner and wax can be measured using a differential scanning calorimeter (DSC measuring device), DCS-7 (from Perkin Elmer, Inc.), or DSC2920 (from TA Instruments Japan). The measurement method is to be in conformance with ASTM D3418-82.

5 to 20 mg, preferably 10 mg of the sample to be measured is prepared by precise weighting. The measured sample is put into an aluminum pan, and using an empty aluminum pan as a reference, the measurement is performed under an ordinary temperature and an ordinary humidity within a measurement range of 30 to 200° C. and at a rate of temperature increase of 10° C./min. As the largest endothermic peaks of the toner and wax, in the process of temperature increase II, one having, in a region not lower than the endothermic peak of Tg of resin, the largest height from the base line, or in the case where it is difficult to discriminate the endothermic peak of Tg of resin since it overlaps another endothermic peak, the highest one of the overlapping peaks, is taken as the largest endothermic peak.

(Measurement of Average Particle Size of Toner)

An average particle size and particle size distribution of a toner can be measured by a known method. In the present invention, it is preferable to measure the average particle size and the particle size distribution by using a measuring apparatus such as COULTER COUNTER TA-II or COULTER MULTISIZER (both manufactured by Beckman Coulter, Inc).

In such a measurement method, a measuring apparatus such as COULTER COUNTER TA-II or COULTER MULTISIZER (both manufactured by Beckman Coulter, Inc) is used by being connected to an interface (manufactured by Nikkaki) and PC 9801 Personal Computer (manufactured by NEC Corporation) for outputting a number distribution and a volume distribution, and an electrolyte is used. A 1% aqueous solution of NaCl prepared by using extra pure sodium chloride or ISOTON R-II (manufactured by Coulter Scientific Japan) can be used for the electrolyte.

A specific measurement method is as follows. 0.1 to 5 ml of a surfactant (preferably an alkyl benzene sulfonate) is added as a dispersant to 100 to 150 ml of the electrolyte, and then 2 to 20 mg of a measurement sample is added to the mixture, followed by dispersion treatment for about 1 to 3 minutes with an ultrasonic dispersing unit. Subsequently, the treated mixture is measured with the measuring apparatus. The volume and number of toners each having a circle-equivalent diameter of 2 μm or more are measured with the COULTER COUNTER TA-II by using, for example, a 100-μm aperture as an aperture to calculate the volume distribution and the number distribution. After that, a weight average particle size (D4) is determined.

(Measurement of Average circularity)

A circle-equivalent diameter and circularity of a toner are used as simple measures of quantitatively expressing shapes of toner particles. In the present invention, measurement is carried out by using a flow-type particle image measuring device 'FPIA-2100' (manufactured by Sysmex Corporation), and the circle-equivalent diameter and the circularity are calculated by using the following equations.

$$A=(B/\pi)^{1/2}\times 2$$

$$ci=Lb/lb$$

$$C=\sum_{i=1}^{m}(ci\times fci)\Big/\sum_{i=1}^{m}(fci)$$

Where "A" is circle-equivalent diameter, and "B" is Projected area of a particle. The "projected area of a particle" is defined as an area of a binarized toner particle image. "ci" is Circularity, "Lb" is circumferential length of a circle having the same area as that of the projected area of a particle, and "Ib" is circumferential length of the projected image of a particle. The "circumferential length of the projected image of a particle" is defined as a length of a borderline drawn by connecting edge points of the toner particle image. "C" is average circularity, and "fci" is frequency of circularities measured in a designated range.

The circularity in the present invention is an indication for the degree of irregularities of a toner particle. If the toner particle is of a complete spherical shape, the circularity is equal to 1.000. The more complicated the surface shape, the lower the value for the circularity.

A specific measurement method is as follows. 10 ml of ion-exchanged water from which an impurity solid or the like has been removed in advance is charged in a vessel, and a surfactant, preferably an alkyl benzene sulfonate, is added as a dispersant to the water. After that, 0.02 g of a measurement sample is added to the mixture, and is uniformly dispersed. An ultrasonic dispersing unit "TETORAL 150" is used as a dispersing means, and the dispersion treatment is performed for 2 minutes to prepare a dispersion for measurement. At that time, the dispersion is appropriately cooled so as not to have a temperature of 40° C. or higher.

The flow-type particle image measuring device is used to measure shapes of toner particles. The concentration of the dispersion is readjusted such that the toner particle concentration at the time of the measurement is 3,000 to 10,000 particles/μl, and 1,000 or more toner particles are measured. After the measurement, by using the data, discarding data for particles each having a particle size of 2 μm or less, and then, an average circularity of toner particles is determined.

(Method of Measuring Viscoelasticity of Toner)

A toner is molded under pressure into a disk-like sample having a diameter of 8 mm and a thickness of about 2 to 3 mm. Then, the sample is set in a parallel plate, and is heated in the temperature range of 50 to 200° C. to carry out temperature dispersion measurement. The rate of temperature increase is set to 2° C./min, the angular frequency (ω) is fixed to 6.28 rad/sec, and the distortion factor is automatically set. Temperatures are represented in an axis of abscissa, whereas storage elastic moduli (G') are represented in an axis of ordinate. Then, a value at each temperature is read. RDA-II (manufactured by Rheometrics) is used for the measurement.

(Measurement of Epoxy Value)

Basic operations are in conformance with JIS K-7236.

(1) 0.5 to 2.0 (g) of a sample is precisely weighted, and the weight is denoted by W (g).

(2) The sample is placed in a 300-ml beaker, and is dissolved in 10 ml of chloroform and 20 ml of acetic acid.

(3) 10 ml of an acetic acid solution of tetraethylammonium bromide is added to the solution. Then, the mixture is subjected to titration with a potentiometric titration apparatus by using a 0.1 mol/l acetic acid solution of perchloric acid. For example, available is automatic titration using a potentiometric titration apparatus AT-400 (WIN WORKSTATION) manufactured by Kyoto Electronics and ABP-410 ELECTRIC BURET. The usage of the acetic acid solution of perchloric acid at this time is denoted by S (ml). A blank is simultaneously measured, and the usage of the acetic acid solution of perchloric acid at this time is denoted by B (ml).

The epoxy value is calculated from the following equation. f is a factor of the acetic acid solution of perchloric acid.

$$\text{Epoxy value (eq/kg)}=0.1\times f\times(S-B)/W$$

(Measurement of Acid Value)

Basic Operations are in Conformance with JIS K-0070.

(1) THF insoluble matter of a toner and a binder resin is removed from a sample before use. Alternatively, soluble matter extracted with a THF solvent by means of Soxhlet extractor obtained in measurement of the above THF insoluble matter is used as a sample. 0.5 to 2.0 (g) of a pulverized product of the sample is precisely weighted, and the weight is denoted by W (g).

(2) The sample is placed in a 300-ml beaker, and 150 ml of a mixture of toluene/ethanol (4/1) is added to the beaker to dissolve the sample in the mixture.

(3) The resultant solution is subjected to titration with a potentiometric titration apparatus by using a 0.1 mol/l ethanol solution of KOH. For example, available is automatic titration using a potentiometric titration apparatus AT-400 (WIN WORKSTATION) manufactured by Kyoto Electronics and ABP-410 ELECTRIC BURET.

(4) The usage of the ethanol solution of KOH at this time is denoted by S (ml). A blank is simultaneously measured, and the usage of the ethanol solution of KOH at this time is denoted by B (ml).

(5) The acid value is calculated from the following equation. f is a factor of KOH.

$$\text{Acid value (mgKOH/g)}=\{(S-B)\times f\times 5.61\}/W$$

EXAMPLES

Hereinafter, specific examples of the present invention will be explained, but the present invention is not limited to the examples.

(Production Example 1 of Vinyl Resin having Epoxy Group)

| | |
|---|---|
| Styrene | 79.2 parts by mass |
| n-butyl acrylate | 19.8 parts by mass |
| Glycidyl methacrylate | 1 part by mass |
| Di-t-butyl peroxide | 5 parts by mass |

While 200 parts by mass of xylene was stirred in a four-necked flask, air in the vessel was sufficiently substituted for nitrogen. Then, the xylene in the vessel was heated to 120° C., and each of the above components was dropped into the vessel for 4 hours. Furthermore, polymerization of the components was completed in xylene reflux, and then the solvent was removed by distillation under a reduced pressure to yield a vinyl resin (1) having an epoxy group. The measured epoxy value of the yielded resin was 2.7 eq/kg.

(Production Example 2 of Vinyl Resin having Epoxy Group).

A vinyl resin (2) having an epoxy group was yielded in the same manner as in Production Example 1 except that the amount of glycidyl methacrylate in Production Example 1 was changed to 0.3 parts by mass. The measured epoxy value of the yielded resin was 0.9 eq/kg.

(Production Example 3 of Vinyl Resin having Epoxy Group)

A vinyl resin (3) having an epoxy group was yielded in the same manner as in Production Example 1 except that the amounts of styrene, n-butyl acrylate, glycidyl methacrylate, and di-t-butylperoxide in Production Example 1 were changed to 72 parts by mass, 18 parts by mass, 6 parts by mass, and 5 parts by mass, respectively. The measured epoxy value of the yielded resin was 4.2 eq/kg.

(Production Example 1 of Hybrid Resin)

Placed in a dropping funnel were 1.9 mol of styrene, 0.21 mol of 2-ethylhexyl acrylate, 0.15 mol of fumaric acid, 0.03 mol of a dimer of a-methylstyrene, and 0.05 mol of dicumyl peroxide as monomers for obtaining a vinyl-based polymer unit. Furthermore, placed in a 4 1 four-necked flask made of glass were 7.0 mol of polyoxypropylene(2.2)-2,2-bis(4-hydroxyphenyl)propane, 3.0 mol of polyoxyethylene(2.2)-2,2-bis(4-hydroxyphenyl)propane, 3.0 mol of succinic acid, 2.0 mol of trimellitic anhydride, and 5.0 mol of fumaric acid as monomers for obtaining a polyester unit, and 0.2 g of dibutyltin oxide. After that, a thermometer, a stirring bar, a condenser, and a nitrogen introducing pipe were installed in the flask, and the flask was placed in a mantle heater. Subsequently, air in the flask was substituted for nitrogen gas, and the mixture in the flask was slowly heated while being stirred. Then, a vinyl-based monomer and a polymerization initiator were dropped from the dropping funnel for 4 hours to the flask while the whole was being stirred at 145° C. Next, the mixture in the flask was heated to 200° C., and was reacted for 4 hours to yield a hybrid resin (1) having a carboxyl group. The measured acid value of the hybrid resin (1) having a carboxyl group was 35 mgKOH/g.

(Production Example 2 of Hybrid Resin)

A hybrid resin (2) having a carboxyl group was yielded in the same manner as in Production Example 1 of Hybrid Resin except that 3.8 mol of styrene, 0.07 mol of a dimer of a-methylstyrene, and 0.1 mol of dicumyl peroxide were used as monomers for obtaining a vinyl-based polymer unit, and that 9.0 mol of polyoxypropylene(2.2)-2,2-bis(4-hydroxyphenyl) propane, 6.0 mol of polyoxyethylene(2.2)-2,2-bis (4-hydroxyphenyl)propane, 1.5 mol of succinic acid, 0.5 mol of trimellitic anhydride, and 1.0 mol of fumaric acid were used as monomers for obtaining a polyester unit. The measured acid value of the hybrid resin (2) having -a carboxyl group was 5 mgKOH/g.

(Production Example 3 of Hybrid Resin)

A hybrid resin (3) having a carboxyl group was yielded in the same manner as in Production Example 1 of Hybrid Resin except that 6.0 mol of maleic acid was used instead of 5.0 mol of fumaric acid, that the addition amount of trimellitic anhydride was changed from 2.0 mol to 3.5 mol, and that 4.5 mol of terephthalic acid was used in stead of 3.0 mol of succinic acid. The measured acid value of the hybrid resin (3) having a carboxyl group was 47 mgKOH/g.

(Hybrid Resin Production Example 4)

A hybrid resin (4) having a carboxyl group was yielded in the same manner as in Production Example 1 of Hybrid Resin except that the addition amount of trimellitic anhydride was changed from 2.0 mol to 5.2 mol. The measured acid value of the hybrid resin (4) having a carboxyl group was 52 mgKOH/g.

(Production Example 1 of Polyester Resin)

Placed in a 4-1 four-necked flask made of glass were 3.6 mol of polyoxypropylene(2.2)-2,2-bis(4-hydroxyphenyl) propane, 1.6 mol of polyoxyethylene(2.2)-2,2-bis(4-hydroxyphenyl)propane, 1.7 mol of terephthalic acid, 1.1 mol of trimellitic anhydride, 2.4 mol of fumaric acid, and 0.1 g of dibutylin oxide. After that a thermometer, a stirring bar, a condenser, and a nitrogen introducing pipe were installed in the flask, and the flask was placed in a mantle heater. The mixture in the flask was reacted for 5 hours at 215° C. in a nitrogen atmosphere to yield a polyester resin (1) having a carboxyl group. The measured acid value of the polyester resin (1) having a carboxyl group was 32 mgKOH/g.

(Production Example 1 of Vinyl-Based Resin)

Placed in a 3 1 four-necked flask equipped with a thermometer, a stainless-steel stirring bar, a condenser, and a nitrogen introducing pipe were 1,000 ml of a toluene solvent, and, as monomers for obtaining a vinyl-based polymer, 2.4 mol of styrene, 0.26 mol of n-butylacrylate., 0.09 mol of monobutyl maleate, and 0.11 mol of di-t-butylperoxide. Then, in a mantle heater, the mixture in the flask was stirred at 120° C. in a nitrogen atmosphere, and was reacted while toluene was refluxed to yield a vinyl-based resin (1).

Example 1

Cyan Toner 1 was produced by the following method.

| | |
|---|---|
| Hybrid resin (1) having carboxyl group | 90 parts by mass |
| Vinyl resin (1) having epoxy group | 10 parts by mass |
| Paraffin wax (A) (DSC endothermic peak: 75° C., Mw: 500, Mn: 390) | 5 parts by mass |
| C.I. Pigment Blue 15:3 | 5 parts by mass |
| Aluminium compound of di-tert-butylsalicylic acid | 2 parts by mass |

The above materials were sufficiently premixed in a HENSCHEL mixer, and the mixture was melted and kneaded at an arbitrary barrel temperature with a biaxial extruder, followed by cooling. The resultant product was roughly pulverized with a HAMMER mill into pieces each having a size of approximately 1 to 2 mm, and then the pieces were finely pulverized with an air-jet type pulverizer. The resultant finely pulverized pieces were treated with the surface modifying device shown in FIG. 1 utilizing classification and a mechanical impact force to provide toner particles with an average circularity of 0.930 for particles each having a circle-equivalent diameter of 2 μm or more.

A binder resin in the resultant toner particles was checked by the above method for reaction between a carboxyl group and an epoxy group. This action confirmed that the carboxyl group of the hybrid resin reacted with the epoxy group of the vinyl resin to form a crosslinked structure.

A reaction between a carboxyl group and an epoxy group was identified similarly in each of cyan toners 2 to 12, a yellow toner 1, and a magenta toner 1 to be described later.

Externally added to and mixed in 100 parts of the above toner particles were 1.5 parts of a titanium oxide fine particle the surface of which had been treated with isobutyltrimethoxysilane and having a primary particle size of 50 nm, resulting in a cyan toner 1 with a weight average particle sizee of 6.5 μm.

The cyan toner 1 and a ferrite carrier (with a volume average particle size of 42 μm) the surface of which had been coated with a silicone resin were mixed to have a toner concentration of 6% by mass, thereby preparing a cyan developer 1.

With the cyan developer 1, using a color copying machine CLC-800 (from Canon Inc.) which has been modified to remove from the machine a fixing unit, a copy with an image area ratio of 20% under an environment of an ordinary temperature and an ordinary humidity (23° C., 60%) is used in a single-color mode while setting a deposition amount of toner per unit area to 1.2 mg/cm$^2$. and images formed by unfixed toner are output continuously onto 50 sheets of plain paper (SK80 from Canon Inc.).

Note that fixing of the output images formed by unfixed toner is effected by an external fixing unit constructed as shown in FIG. 4 under an environment of an ordinary temperature and an ordinary humidity. As the heat-resisting film, one having an elastic layer of 300 μm in thickness is used. For the evaluation of a fixable area, the external fixing unit modified so that setting of the fixing temperature can be made manually is used.

In addition, using OHP sheets instead of the above-mentioned plain paper, the images formed from unfixed toner output in the same manner as described above are fixed to the OHP sheets by using the modified external fixing unit described above. Then, a transparency of images formed on the OHP sheets is measured. For the measurement of the transparency, a spectrophotometer UV2200 (from Shimadzu Corporation) is used, with the transparency obtained when using the OHP sheet alone taken as 100%. In the case of cyan toner, the transparency at 500 nm as the maximum absorption wavelength is measured and evaluated. When using magenta toner and yellow toner, the measurement wavelengths are set as 720 nm and 580 nm, respectively. The evaluation criteria are as follows.

A: 70% or more (very good transparency)

B: 60% or more and below 70% (good transparency)

C: 50% or more and below 60% (transparency of a level causing no practical problem)

D: 40% or more and below 50% (rather poor transparency)

E: below 40% (very poor transparency)

A blocking resistance of the sample toner is evaluated by leaving the sample toner for two weeks in an oven of 50° C. The evaluation is performed by determining a level of agglomeration through visual observation. The evaluation criteria are as follows.

A: The sample toner exhibits very good blocking resistance, with no changes observed before and after the placement into the oven.

B: Although agglomerations are observed slightly, the blocking resistance is of a level causing no practical problem.

C: Agglomerations are observed in large number, and a solid spotted image is observed in an output image.

D: The toner solidifies, with its particles strongly agglomerated.

Further, for measurement of the granularity in an image, within a low density region, an image with which an optical density in the vicinity of 0.35 is attained is extracted. A 256×256 pixel area in a halftone patch thereof is read with a drum scanner at a resolution of 1000 dpi, and an RGB value in that area is converted into a lightness (L*) value.

Thereafter, after the L* value data is transformed by the Fourier transform into a spatial frequency, it is weighted by visual spatial frequency characteristics (VTF) for transformation into frequency information that may be recognized by the eyes, and a value thereof is integrated over all frequency bands to obtain a roughness degree. Note that, in the case where there is no patch with an optical density of 0.35, the roughness degree is calculated using the lightness of an image with an optical density of 0.35, by using data obtained on several points in the vicinity thereof with optical densities in the neighborhood of 0.35.

A graininess (roughness degree) of each image obtained as described above is evaluated and ranked at the following criteria.

A: below 32.0 (Very good graininess, with no roughness perceived)

B: 32.1 to 34.0 (Good graininess, with hardly any roughness perceived)

C, 34.1 to 36.0 (Although slight roughness is perceived, the graininess is of a level causing no practical problem)

D: 36.1 to 38.0 (Roughness is perceived)

E: 38.1 or more (Substantial roughness is perceived)

The toner obtained in Example 1 is excellent in blocking resistance and a fixable area thereof is also large. In addition, an image obtained with the toner exhibits excellent graininess, and a transparency of an OHP image obtained with the toner is also excellent. Further, as regards a fixing device, a fixing device exhibits an excellent quick-start property and is thus capable of fast image fixing. Physical properties of the toner, and evaluation results thereof are shown in Table 1 and Table 2, respectively.

Note that, when image formation is performed by changing the external fixing unit used to a fixing device constructed as shown in FIG. 5, the image formation can likewise be performed in a favorable manner.

Example 2

A cyan toner 2 was prepared in nearly the same manner as in Example 1 except that the hybrid resin (2) was used instead of the hybrid resin (1) and that the compounding ratio of the hybrid resin to the vinyl resin having an epoxy group was changed to 70 parts by mass: 30 parts by mass, and then a cyan developer 2 was similarly prepared. Table 1 shows the physical properties of the cyan toner 2, and Table 2 shows the results of evaluation of the cyan toner 2.

Example 4

A cyan toner 4 was prepared in nearly the same manner as in Example 1 except that the hybrid resin (3) was used instead of the hybrid resin (1) and that the compounding ratio of the hybrid resin to the vinyl resin having an epoxy group was changed to 97 parts by mass: 3 parts by mass, and then a cyan developer 4 was similarly prepared. Table 1 shows the physical properties of the cyan toner 4, and Table 2 shows the results of evaluation of the cyan toner 4.

Example 5

A cyan toner 5 was prepared in nearly the same manner as in Example 1 except that a blend of the hybrid resin (1) and the vinyl-based resin (1) was used instead of the hybrid resin (1), and then a cyan developer 5 was similarly prepared. Table 1 shows the physical properties of the cyan toner 5, and Table 2 shows the results of evaluation of the cyan toner 5.

Example 6

A cyan toner 6 was prepared in nearly the same manner as in Example 1 except that a blend of the hybrid resin (1) and the polyester resin (1) was used instead of the hybrid resin (1), and then a cyan developer 6 was similarly prepared. Table 1 shows the physical properties of the cyan toner 6, and Table 2 shows the results of evaluation of the cyan toner 6.

Example 7

A cyan toner 7 was prepared in nearly the same manner as in Example 1 except that a polyethylene wax (A) (DSC endothermic peak: 97.5° C., Mw: 850, Mn: 610) was used instead of the paraffin wax (A), and then a cyan developer 7 was similarly prepared. Table 1 shows the physical properties of the cyan toner 7, and Table 2 shows the results of evaluation of the cyan toner 7.

Example 8

A cyan toner 8 was prepared in nearly the same manner as in Example 1 except that the compounding ratio of the vinyl resin (1) having an epoxy group to the hybrid resin (1) was changed to 30 parts by mass: 70 parts by mass and that a polyethylene wax (B) (DSC endothermic peak: 102° C., Mw: 908, Mn: 672) was used instead of the paraffin wax (A), and then a cyan developer 8 was similarly prepared. Table 1 shows the physical properties of the cyan toner 8, and Table 2 shows the results of evaluation of the cyan toner 8.

Example 9

A cyan toner 9 was prepared in nearly the same manner as in Example 1 except that a carnauba wax (DSC endothermic peak: 83.0° C., Mw: 880, Mn: 630) was used instead of the paraffin wax (A), and then a cyan developer 9 was similarly prepared. Table 1 shows the physical properties of the cyan toner 9, and Table 2 shows the results of evaluation of the cyan toner 9.

Example 10

A cyan toner 10 was prepared in nearly the same manner as in Example 1 except that an alcohol modified paraffin wax (DSC endothermic peak: 75.2° C., Mw: 910, Mn: 650, acid value: 8, OH value: 65) was used instead of the paraffin wax (A), and then a cyan developer 10 was similarly prepared. Table 1 shows the physical properties of the cyan toner 10, and Table 2 shows the results of evaluation of the cyan toner 10.

Example 11

A cyan toner 11 was prepared in nearly the same manner as in Example 1 except that a paraffin wax (B) (DSC endothermic peak: 67.5° C., Mw: 450, Mn: 310) was used instead of the paraffin wax (A) and that the organometallic compound was changed from the aluminum compound of di-tert-butylsalicylic acid to a zinc compound of di-tert-butylsalicylic acid, and then a cyan developer 11 was similarly prepared. Table 1 shows the physical properties of the cyan toner 11, and Table 2 shows the results of evaluation of the cyan toner 11.

Example 12

A cyan toner 12 was prepared in nearly the same manner as in Example 1 except that the vinyl resin (2) having an epoxy group was used instead of the vinyl resin (1) having an epoxy group and that the compounding ratio of the vinyl resin (2) having an epoxy group to the hybrid resin (1) was changed to 30 parts by mass: 70 parts by mass, and then a cyan developer 12 was similarly prepared. Table 1 shows the physical properties of the cyan toner 12, and Table 2 shows the results of evaluation of the cyan toner 12.

Example 13

A magenta toner 1 was prepared in nearly the same manner as in Example 1 except that C.I. Pigment Red 122 was used instead of C.I. Pigment Blue 15:3, and then a magenta developer 1 was similarly prepared. Table 1 shows the physical properties of the magenta toner 1, and Table 2 shows the results of evaluation of the magenta toner 1.

Example 14

A yellow toner 1 was prepared in nearly the same manner as in Example 1 except that C.I. Pigment Yellow 180 was used instead of C.I. Pigment Blue 15:3, and then a yellow developer 1 was similarly prepared. Table 1 shows the physical properties of the yellow toner 1, and Table 2 shows the results of evaluation of the yellow toner 1.

Comparative Example 1

A cyan toner 13 was prepared in nearly the same manner as in Example 1 except that the vinyl resin (1) having an epoxy group was not used and that the addition amount of the hybrid resin (1) was changed to 100 parts by mass, and then a cyan developer 13 was similarly prepared. Table 1 shows the physical properties of the cyan toner 13, and Table 2 shows the results of evaluation of the cyan toner 13.

Since the vinyl resin (1) having an epoxy group was not used, no crosslinking reaction between a carboxyl group and an epoxy group took place upon kneading. Therefore, hot offset resistance significantly deteriorated in a fixing system with a comparatively light pressure such as the heating system employed in the above mentioned examples. Moreover, circularity when the toner was rounded increased, so that the toner passed through the cleaning member and faulty cleaning occurred from an initial stage. Furthermore, exudation of the wax to the toner surface reduced transferability, resulting in remarkably deteriorated graininess (degree of roughness).

Comparative Example 2

A cyan toner 14 was prepared in nearly the same manner as in Example 1 except that the hybrid resin (1) was not used, that 10 parts by mass of the vinyl resin (1) having an epoxy group was changed to 100 parts by mass of the vinyl resin (3) having an epoxy group, and that the paraffin wax (C) (DSC endothermic peak: 57.5° C., Mw.: 350, Mn: 2.80) was used instead of the paraffin wax (A), and then a cyan developer 14 was similarly prepared. Table 1 shows the physical properties of the cyan toner 14, and Table 2 shows the results of evaluation of the cyan toner 14.

When only a vinyl resin having an epoxy group was used, hot offset resistance significantly deteriorated in a fixing system with a comparatively light pressure such as the heating system employed in the above-mentioned examples. In addition, blocking resistance significantly deteriorated at the same time. Moreover, circularity when the toner was rounded increased, so that the toner passed through the cleaning member and faulty cleaning occurred from an initial stage. Furthermore, exudation of the wax to the toner surface reduced transferability, resulting in remarkably deteriorated graininess (degree of roughness).

Comparative Example 3

A cyan toner 15 was prepared in nearly the same manner as in Example 1 except that the vinyl resin (1) having an epoxy group was not used, that 100 parts by mass of the hybrid resin (4) was used instead of 90 parts by mass of the hybrid resin (1), and that a polypropylene wax (DSC endothermic peak: 133.5° C., Mw: 1700, Mn: 1290) was used instead of the paraffin wax (A), and then a cyan developer 15 was similarly prepared. Table 1 shows the physical properties of the cyan toner 15, and Table 2 shows the results of evaluation of the cyan toner 15.

The hybrid resin (4) had a large molecular weight, and the wax was unable to effectively exude to the toner surface upon fixing in a fixing system with a comparatively light pressure such as the present heating system, so that the fixing area remarkably deteriorated. Moreover, circularity when the toner was rounded decreased, so that transferability reduced, resulting in deterioration of graininess (degree of roughness).

TABLE 1-1

| | | Binder Resin | | | | |
|---|---|---|---|---|---|---|
| | Toner | Vinyl resin having epoxy group A | Epoxy value of resin of left column (eq/kg) | Other resins B | Acid value of resin of left column (mgKOH/g) | Ratio of B to A |
| Example 1 | Cyan Toner 1 | Vinyl resin having epoxy group (1) | 2.7 | Hybrid resin (1) | 35 | 90:10 |
| Example 2 | Cyan Toner 2 | Vinyl resin having epoxy group (1) | 2.7 | Hybrid resin (2) | 5 | 70:30 |
| Example 3 | Cyan Toner 3 | Vinyl resin having epoxy group (1) | 2.7 | Polyester resin (1) | 32 | 90:10 |
| Example 4 | Cyan Toner 4 | Vinyl resin having epoxy group (1) | 2.7 | Hybrid resin (3) | 47 | 97:3 |
| Example 5 | Cyan Toner 5 | Vinyl resin having epoxy group (1) | 2.7 | Blend of hybrid resin (1) and vinyl-based resin (1) | 34 | 90:10 |

TABLE 1-1-continued

| | Toner | Binder Resin: Vinyl resin having epoxy group A | Epoxy value of resin of left column (eq/kg) | Other resins B | Acid value of resin of left column (mgKOH/g) | Ratio of B to A |
|---|---|---|---|---|---|---|
| Example 6 | Cyan Toner 6 | Vinyl resin having epoxy group (1) | 2.7 | Blend of hybrid resin (1) and polyester resin (1) | 34 | 90:10 |
| Example 7 | Cyan Toner 7 | Vinyl resin having epoxy group (1) | 2.7 | Hybrid resin (1) | 35 | 90:10 |
| Example 8 | Cyan Toner 8 | Vinyl resin having epoxy group (1) | 2.7 | Hybrid resin (1) | 35 | 70:30 |
| Example 9 | Cyan Toner 9 | Vinyl resin having epoxy group (1) | 2.7 | Hybrid resin (1) | 35 | 90:10 |
| Example 10 | Cyan Toner 10 | Vinyl resin having epoxy group (1) | 2.7 | Hybrid resin (1) | 35 | 90:10 |
| Example 11 | Cyan Toner 11 | Vinyl resin having epoxy group (1) | 2.7 | Hybrid resin (1) | 35 | 90:10 |
| Example 12 | Cyan Toner 12 | Vinyl resin having epoxy group (2) | 0.9 | Hybrid resin (1) | 35 | 70:30 |

TABLE 1-2

| | Toner | Binder Resin: Vinyl resin having epoxy group A | Epoxy value of resin of left column (eq/kg) | Other resins B | Acid value of resin of left column (mgKOH/g) | Ratio of B to A |
|---|---|---|---|---|---|---|
| Example 13 | Magenta Toner 1 | Vinyl resin having epoxy group (1) | 2.7 | Hybrid resin (1) | 35 | 90:10 |
| Example 14 | Yellow Toner 1 | Vinyl resin having epoxy group (1) | 2.7 | Hybrid resin (1) | 35 | 90:10 |
| Comparative Example 1 | Cyan Toner 13 | — | — | Hybrid resin (1) | 35 | 100:0 |
| Comparative Example 2 | Cyan Toner 14 | Vinyl resin having epoxy group (3) | 4.2 | — | — | 0:100 |
| Comparative Example 3 | Cyan Toner 15 | — | — | Hybrid resin (4) | 52 | 100:0 |

TABLE 1-3

| | Toner No. | G' 80 (Pa) | G' 160 (Pa) | Kind of wax | Maximum value of endothermic peak of toner (° C.) | GPC measurements of toner: Mw | Mn | Mp | Average circularity of toner having circle-equivalent diameter of 2 μm or more |
|---|---|---|---|---|---|---|---|---|---|
| Example 1 | Cyan Toner 1 | $2.2 \times 10^7$ | $1.2 \times 10^3$ | Paraffin wax (A) | 74.8 | 2,054,760 | 2,910 | 7,820 | 0.930 |
| Example 2 | Cyan Toner 2 | $7.1 \times 10^6$ | $5.5 \times 10^3$ | Paraffin wax (A) | 74.8 | 2,713,980 | 2,710 | 8,250 | 0.928 |
| Example 3 | Cyan Toner 3 | $8.8 \times 10^7$ | $9.6 \times 10^3$ | Paraffin wax (A) | 74.8 | 4,875,000 | 4,530 | 9,510 | 0.931 |
| Example 4 | Cyan Toner 4 | $1.2 \times 10^7$ | $8.6 \times 10^3$ | Paraffin wax (A) | 74.8 | 3,259,820 | 2,690 | 7,580 | 0.935 |
| Example 5 | Cyan Toner 5 | $8.8 \times 10^7$ | $7.3 \times 10^2$ | Paraffin wax (A) | 74.8 | 1,158,880 | 2,270 | 7,770 | 0.940 |
| Example 6 | Cyan Toner 6 | $6.6 \times 10^7$ | $1.4 \times 10^3$ | Paraffin wax (A) | 74.8 | 2,197,230 | 1,750 | 7,260 | 0.938 |
| Example 7 | Cyan Toner 7 | $7.4 \times 10^7$ | $1.8 \times 10^3$ | Polyethylene wax (A) | 99.0 | 2,243,650 | 2,850 | 8,020 | 0.935 |
| Example 8 | Cyan Toner 8 | $6.6 \times 10^7$ | $1.5 \times 10^3$ | Polyethylene wax (B) | 103.0 | 1,986,710 | 2,460 | 8,160 | 0.933 |
| Example 9 | Cyan Toner 9 | $8.2 \times 10^7$ | $2.1 \times 10^3$ | Carnauba wax | 83.3 | 2,897,320 | 2,610 | 7,960 | 0.935 |
| Example 10 | Cyan Toner 10 | $7.7 \times 10^7$ | $1.5 \times 10^3$ | Alcohol modified paraffin wax | 76.0 | 2,556,710 | 2,260 | 7,780 | 0.932 |
| Example 11 | Cyan Toner 11 | $8.0 \times 10^7$ | $1.6 \times 10^3$ | Paraffin wax (B) | 68.0 | 2,103,640 | 2,740 | 8,060 | 0.935 |
| Example 12 | Cyan Toner 12 | $7.3 \times 10^6$ | $5.3 \times 10^3$ | Paraffin wax (A) | 74.8 | 2,033,860 | 2,870 | 7,810 | 0.932 |

TABLE 1-4

| | Toner No | G' 80 (Pa) | G' 160 (Pa) | Kind of wax | Maximum value of endothermic peak of toner (° C.) | GPC measurements of toner Mw | Mn | Mp | Average circularity of toner having circle-equivalent diameter of 2 μm or more |
|---|---|---|---|---|---|---|---|---|---|
| Example 13 | Magenta Toner 1 | $7.9 \times 10^7$ | $1.4 \times 10^3$ | Paraffin wax (A) | 74.8 | 2,470,300 | 2,570 | 7,960 | 0.931 |
| Example 14 | Yellow Toner 1 | $8.9 \times 10^7$ | $1.3 \times 10^3$ | Paraffin wax (A) | 74.8 | 2,264,310 | 3,010 | 8,000 | 0.932 |
| Comparative Example 1 | Cyan Toner 13 | $8.8 \times 10^4$ | $9.8 \times 10^0$ | Paraffin wax (A) | 74.8 | 1,568,720 | 2,060 | 6,360 | 0.947 |
| Comparative Example 2 | Cyan Toner 14 | $2.1 \times 10^4$ | *1 | Paraffin wax (C) | 58.0 | 9,710 | 3,860 | 3,090 | 0.949 |
| Comparative Example 3 | Cyan Toner 15 | $2.6 \times 10^9$ | $2.2 \times 10^4$ | Polypropylene wax | 134.2 | 5,789,720 | 5,090 | 18,278 | 0.918 |

*1: Not measurable owing to elution from cell

TABLE 2-1

| | Toner No. | Fixing temperature region: Fixing start temperature (° C.) | Offset generating temperature (° C.) | OHP transparency | Blocking resistance | Degree of roughness |
|---|---|---|---|---|---|---|
| Example 1 | Cyan Toner 1 | 110 | 220 | 75.9%: A | A | 30.2%: A |
| Example 2 | Cyan Toner 2 | 115 | 210 | 68.2%: B | A | 30.7%: A |
| Example 3 | Cyan Toner 3 | 110 | 220 | 74.2%: A | A | 31.5%: A |
| Example 4 | Cyan Toner 4 | 120 | 225 | 67.3%: B | A | 31.6%: A |
| Example 5 | Cyan Toner 5 | 110 | 190 | 73.8%: A | B | 31.8%: A |
| Example 6 | Cyan Toner 6 | 115 | 220 | 66.9%: B | B | 31.8%: A |
| Example 7 | Cyan Toner 7 | 130 | 200 | 65.3%: B | A | 32.3%: B |
| Example 8 | Cyan Toner 8 | 135 | 205 | 63.8%: B | A | 32.7%: B |
| Example 9 | Cyan Toner 9 | 140 | 210 | 62.1%: B | A | 33.1%: B |
| Example 10 | Cyan Toner 10 | 125 | 205 | 61.9%: B | B | 33.3%: B |
| Example 11 | Cyan Toner 11 | 110 | 185 | 60.8%: B | B | 33.7%: B |
| Example 12 | Cyan Toner 12 | 120 | 180 | 60.3%: B | B | 33.2%: B |

TABLE 2-2

| | Toner No | Fixing temperature region: Fixing start temperature (° C.) | Offset generating temperature (° C.) | OHP transparency | Blocking resistance | Degree of roughness |
|---|---|---|---|---|---|---|
| Example 13 | Magenta Toner 1 | 110 | 220 | 75.0%: A | A | 30.4%: A |
| Example 14 | Yellow Toner 1 | 110 | 215 | 74.9%: A | A | 30.5%: A |
| Comparative Example 1 | Cyan Toner 13 | 120 | 165 | 47.8%: D | D | 37.3%: D |
| Comparative Example 2 | Cyan Toner 14 | 135 | 165 | 45.3%: D | E | 38.5%: E |
| Comparative Example 3 | Cyan Toner 15 | 150 | 165 | 35.3%: E | C | 39.2%: E |

What is claimed is:

1. A toner comprising toner particles each comprising at least a binder resin, a wax, and a colorant, wherein:

the binder resin comprises a resin formed by a reaction between an epoxy group of a vinyl resin (A) having the epoxy group and a carboxyl group of a resin (B) having at least a polyester unit and the carboxyl group;

the toner has: a storage elastic modulus at a temperature of 80° C. (G' 80) in a range of $1\times10^5$ to $1\times10^8$ Pa and has a storage elastic modulus at a temperature of 160° C. (G' 160) in a range of $1\times10^1$ to $1\times10^4$ Pa; and the resin (B) is a resin selected from the group consisting of the following items (a) and (c) and the resin (B) has an acid value in a range of 0.1 to 50 mgKOH/g, wherein (a) is a hybrid resin having a carboxyl group; and (c) is a mixture of a hybrid resin having a carboxyl group and a polyester resin having a carboxyl group.

2. The toner according to claim 1, wherein the vinyl resin (A) has an epoxy value in a range of 0.05 to 3.0 eq/kg.

3. The toner according to claim 1, wherein, in a molecular weight distribution measured by gel permeation chromatography (GPC) of tetrahydrofuran (THF) soluble matter of the toner, a number average molecular weight (Mn) of the toner is in a range of 1,000 to 5,000 and a weight average molecular weight (Mw) of the toner is in a range of 10,000 to 5,000,000.

4. The toner according to claim 1, wherein, in a molecular weight distribution measured by gel permeation chromatography (GPC) of tetrahydrofuran (THF) soluble matter of the toner, the toner has a main peak in a range of 1,000 to 15,000 in a molecular weight.

5. The toner according to claim 1, wherein the toner comprises at least one wax selected from the group consisting of an aliphatic hydrocarbon-based wax, an oxide of an aliphatic hydrocarbon-based wax, a wax comprised of an ester of fatty acid mainly, and a wax in which the ester of fatty acid is partly or fully deoxidized.

6. The toner according to claim 1, wherein, in an endothermic curve in differential scanning calorimetry of the toner, the toner has one or plural endothermic peaks in a temperature range of 30 to 200° C., and a maximum value of the largest endothermic peak of the endothermic peaks is in a temperature range of 60 to 105° C.

7. The toner according to claim 1, wherein the toner further comprises a metallic compound of an aromatic carboxylic acid.

8. The toner according to claim 1, wherein an average circularity of the particles each having a circle-equivalent diameter of 2 μm or more is in a range of 0.920 to 0.945.

9. A method for forming a toner image fixed onto a recording material comprising:

(a) forming an unfixed toner image on the recording material by using means for forming an unfixed toner image on the recording material; and (b) fixing the unfixed toner image to the recording material by using a fixing means for fixing the unfixed toner image to the recording material;

wherein the fixing means includes a heating means, a rotatable endless fixing belt heated by the heating means, and a pressurizing member pressurizing the fixing belt to form a nip portion in which the recording material is nipped between the fixing belt and the pressurizing member and the fixing means fixes the unfixed toner image formed on the recording material to the recording material in the nip portion;

wherein the fixing belt has a tubular metallic conductor and an elastic layer covering an outer peripheral surface of the metallic conductor;

wherein the heating means heats the fixing belt by generating an eddy current in the fixing belt; and wherein a toner used for forming the toner image is according to claim 1.

10. A method for forming a toner image fixed onto a recording material comprising:

(a) forming an unfixed toner image on the recording material by using means for forming an unfixed toner image on the recording material; and (b) fixing the unfixed toner image to the recording material by using a fixing means for fixing the unfixed toner image to the recording material;

wherein the fixing means includes a heating means, a rotatable endless heat-resisting film, and a pressurizing means for pressuring the heat-resisting film against the heating means to form a nip portion in which the recording material is nipped between the pressurizing means and the heat-resisting film, and the fixing means fixes the unfixed toner image formed on the recording material to the recording material in the nip portion, and wherein a toner used for forming the toner image is according to claim 1.

* * * * *

UNITED STATES PATENT AND TRADEMARK OFFICE

CERTIFICATE OF CORRECTION

PATENT NO. : 7,147,980 B2
APPLICATION NO. : 10/753490
DATED : December 12, 2006
INVENTOR(S) : Takayuki Itakura et al.

It is certified that error appears in the above-identified patent and that said Letters Patent is hereby corrected as shown below:

COLUMN 2:

Line 17, "wax, the use" should read --wax. The use--.

COLUMN 34:

Table 1-1,

| | | | | | | | |
|---|---|---|---|---|---|---|---|
| "Example 3 | Cyan Toner 3 | Vinyl resin having epoxy group (1) | 2.7 | Polyester resin (1) | 32 | 90:00 | " |

should be deleted.

COLUMN 35:

Table 1-3,

| | | | | | | | | | |
|---|---|---|---|---|---|---|---|---|---|
| "Example 3 | Cyan Toner 3 | $8.8 \times 10^7$ | $9.6 \times 10^3$ | Paraffin wax (A) | 74.8 | 4875,000 | 4530 | 9,510 | 0.931 " |

should be deleted.

UNITED STATES PATENT AND TRADEMARK OFFICE

CERTIFICATE OF CORRECTION

PATENT NO. : 7,147,980 B2
APPLICATION NO. : 10/753490
DATED : December 12, 2006
INVENTOR(S) : Takayuki Itakura et al.

It is certified that error appears in the above-identified patent and that said Letters Patent is hereby corrected as shown below:

COLUMN 37:

Table 2-1,

"Example 3 Cyan Toner 3 110 220 74.2%: A A 31.5%: A"

should be deleted, and

Line 67 Claim 1 Col. 37, "$1x10^8$ Pa" should read --$1x10^8$ Pa,--.

Signed and Sealed this

Twenty-fourth Day of June, 2008

JON W. DUDAS
*Director of the United States Patent and Trademark Office*